US011437752B2

(12) United States Patent
Phatiwuttipat et al.

(10) Patent No.: US 11,437,752 B2
(45) Date of Patent: Sep. 6, 2022

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Pipatthana Phatiwuttipat, Mie (JP); Hajime Kawase, Mie (JP); Masaaki Tabata, Mie (JP); Yasuo Omori, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/041,179

(22) PCT Filed: Mar. 22, 2019

(86) PCT No.: PCT/JP2019/011960
§ 371 (c)(1),
(2) Date: Sep. 24, 2020

(87) PCT Pub. No.: WO2019/188738
PCT Pub. Date: Oct. 3, 2019

(65) Prior Publication Data

US 2021/0098931 A1 Apr. 1, 2021

(30) Foreign Application Priority Data

Mar. 30, 2018 (JP) ..... JP2018-066903

(51) Int. Cl.
*H01R 13/506* (2006.01)
*H01R 12/77* (2011.01)
*H01R 13/42* (2006.01)

(52) U.S. Cl.
CPC ..... *H01R 13/506* (2013.01); *H01R 12/778* (2013.01); *H01R 13/42* (2013.01)

(58) Field of Classification Search
CPC .. H01R 13/506; H01R 13/514; H01R 12/778; H01R 13/6273
See application file for complete search history.

(56) References Cited

U.S. PATENT DOCUMENTS 5,100,345 A 3/1992 Endo et al.
5,419,722 A 5/1995 Onoda
(Continued)

FOREIGN PATENT DOCUMENTS

JP 2003-203695 A 7/2003
JP 2018-032534 A 3/2018

OTHER PUBLICATIONS

International Search Report dated May 14, 2019 for WO 2019/188738 A1 (4 pages).

*Primary Examiner* — Briggitte R. Hammond
(74) *Attorney, Agent, or Firm* — Venjuris, P.C.

(57) ABSTRACT

Looseness of two housings are suppressed. A connector includes a lower housing and an upper housing. The lower housing is provided with a locking portion. The upper housing is provided with an elastic locking piece that is hooked on the locking portion. The elastic locking piece has a cantilever shape, and restricts relative movement of the lower housing and the upper housing in a separation direction, which is a direction opposite to a coupling direction. The lower housing is provided with a protruding piece portion that protrude outward in a left-right direction. The upper housing is provided with a protruding piece restriction
(Continued)

portion that restricts movement of the protruding piece portion. The protruding piece restriction portion is provided with an inclined surface that is inclined in an assembly direction to reduce a movable range of the protruding piece portion in a separation direction.

8 Claims, 24 Drawing Sheets

(56) References Cited

U.S. PATENT DOCUMENTS

| | | | | |
|---|---|---|---|---|
| 5,947,774 | A * | 9/1999 | Abe | H01R 13/514<br>439/701 |
| 7,081,003 | B1 * | 7/2006 | Gregori | H01R 13/516<br>439/352 |
| 7,878,833 | B2 * | 2/2011 | Chen | H01R 13/5045<br>439/284 |
| 2001/0055921 | A1 | 12/2001 | Kuhnel | |
| 2012/0295491 | A1 * | 11/2012 | Ito | H01R 13/4361<br>439/731 |

* cited by examiner

CONNECTOR

CROSS REFERENCE TO RELATED APPLICATIONS

This application is a national phase of PCT application No. PCT/JP2019/011960, filed on 22 Mar. 2019, which claims priority from Japanese patent application No. 2018-066903, filed on 30 Mar. 2018, all of which are incorporated herein by reference.

TECHNICAL FIELD

The present invention relates to a connector.

BACKGROUND

Patent Document 1 discloses a connector that has a divided structure including two portions, namely an upper portion and a lower portion, and in which terminal accommodating chambers for accommodating terminal fittings can be divided into upper portions and lower portions due to the divided structure. This connector includes two housings, namely an upper housing and a lower housing. The lower housing is provided with elastic locking pieces, and the upper housing is provided with locking portions on which the elastic locking pieces are hooked. To assemble this connector, terminal fittings are placed on the top face of the lower housing, and then the upper housing is put on the lower housing. In the process of coupling the upper and lower housings, the elastic locking pieces are pressed by the upper housing and elastically deformed to be inclined. After the two housings have been coupled, the protrusions of the elastic locking pieces have passed the locking portions, and thus the elastic locking pieces are elastically restored and hooked on the locking portions. Accordingly, movement of the upper and lower housings in a direction in which the upper and lower housings are detached from each other is restricted.

PRIOR ART DOCUMENT

Patent Document

Patent Document 1: JP 2018-32534A

SUMMARY OF THE INVENTION

Problems to be Solved

However, in the configuration in which the assembly is completed by hooking the elastic locking pieces on the locking portions as described above, the elastic locking pieces are elastically restored while swinging about the fixed ends thereof in the process of coupling the two housings, and therefore, gaps are formed between the protrusions of the elastic locking pieces and the locking portions after the two housings have been coupled. Accordingly, there is a problem in that the upper and lower housings become loose in the direction in which the upper and lower housings are detached from each other.

The present invention was made in view of the above-mentioned conventional circumstances, and a problem to be solved is to provide a technique according to which looseness of the two housings can be suppressed.

Means to Solve the Problem

A connector of the present invention includes:

a first housing and a second housing that are first coupled to each other and brought into a coupled state, and then are moved relative to each other in an assembly direction intersecting a coupling direction and brought into an assembled state;

a terminal fitting that is accommodated between the first housing and the second housing;

a locking portion that is formed on the first housing;

an elastic locking piece that has a cantilever shape, is formed on the second housing, is hooked on the locking portion in the coupled state, and restricts relative movement of the first housing and the second housing in a separation direction, which is a direction opposite to the coupling direction;

a protruding piece portion that is formed on one of the first housing and the second housing, and protrudes in a direction intersecting the coupling direction and the assembly direction; and a protruding piece restriction portion that is formed on the other of the first housing and the second housing, and restricts movement of the protruding piece portion, wherein the protruding piece restriction portion is provided with an inclined surface that is inclined in the assembly direction to reduce a movable range of the protruding piece portion in the separation direction.

Effect of the Invention

With the connector of the present invention, in the process of completing the assembly after bringing the connector into a coupled state by hooking the elastic locking piece on the locking portion, the movable range of the protruding piece portion in the separation direction is reduced. Accordingly, looseness of the first housing and the second housing in the separation direction can be suppressed.

Figure 1:
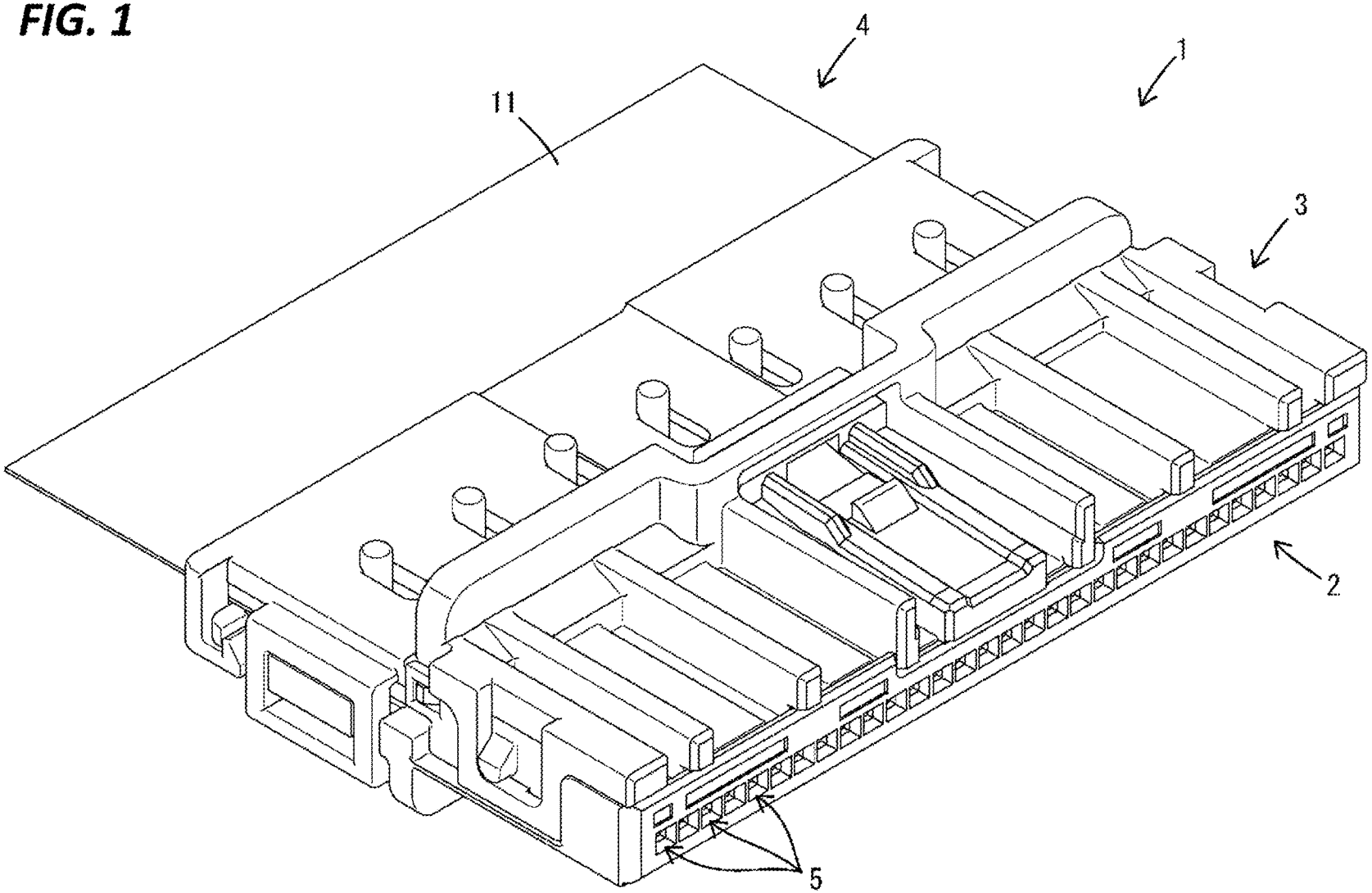
FIG. 1 is a perspective view of a connector of Embodiment 1 as viewed from an upper front side.

DETAILED DESCRIPTION TO EXECUTE THE INVENTION (1) In the connector of the present invention, the protruding piece restriction portion may be constituted by the elastic locking piece. The inclined surface may be formed on the elastic locking piece. The protruding piece portion may be constituted by the locking portion.

With this configuration, the structure of the connector can be simplified compared with the case where the elastic locking piece and the protruding piece restriction portion are separately formed, or the protruding piece portion and the locking portion are separately formed.

(2) In the connector of the present invention, one of the first housing and the second housing may be provided with a fitting portion. The other of the first housing and the second housing may be provided with a fitting hole into which the fitting portion is fitted in a process of moving the first housing and the second housing in the coupled state relative to each other to bring the first housing and the second housing into the assembled state.

With this configuration, the two housings are fitted to each other in the process of assembling the two housings in the coupled state thereof, and therefore, movement of the two housings in the assembled state is restricted in the separation direction intersecting the assembly direction. Accordingly, looseness of the two housings in the separation direction can be more reliably suppressed.

(3) In the connector of the present invention, the elastic locking piece may be provided with a lock positioning portion that positions the protruding piece portion before the first housing and the second housing are brought into the coupled state.

With this configuration, the two housings can be easily positioned in the assembly direction when being coupled.

(4) In the connector of the present invention, one of the first housing and the second housing may be provided with a pin that rises toward the other housing. The other housing may be provided with a relief hole through which the pin passes. The pin may be provided with a pin restriction portion that restricts movement of a hole edge portion included in an inner circumference of the relief hole in the separation direction in the assembled state.

With this configuration, movement of the hole edge portion in the separation direction is restricted in the assembled state, and thus looseness of the two housings in the separation direction can be more reliably suppressed.

(5) In the connector of the present invention, one of the first housing and the second housing is provided with swinging locking portions that swing about hinges serving as a supporting point, at two ends thereof in a direction orthogonal to the coupling direction. The other housing may also be provided with hook portions on which the swinging locking portions are hooked only in a state in which the first housing and the second housing are located at positions at which they are in the assembled state.

With this configuration, due to the swinging locking portions being hooked on the hook portions, looseness of the two housings in the separation direction can be suppressed, and it can be confirmed whether or not the two housings are in the assembled state.

Embodiment 1

Hereinafter, Embodiment 1 in which the present invention is embodied will be described with reference to FIGS. 1 to 25. It should be noted that, regarding the front-rear direction, a side indicated by a direction in which a connector 1 is fitted into a counterpart connector (not shown) (right side in FIGS. 9, 16, 19, 21, 23, and 24, and lower side in FIGS. 3, 7, 8, 14, 15, 17, 18, 20, and 22) is defined as the "front side", and a side indicated by the opposite direction is defined as the "rear side". The vertical direction in FIGS. 5, 6, 9, 12, 13, 16, 19, 21, 23, and 24 is defined as the "vertical direction" as it is, and the left-right direction in FIGS. 3, 5 to 8, 12 to 15, 17, 18, 20, and 22 is defined as the "left-right direction" as it is.

<Connector 1>

Figure 2:
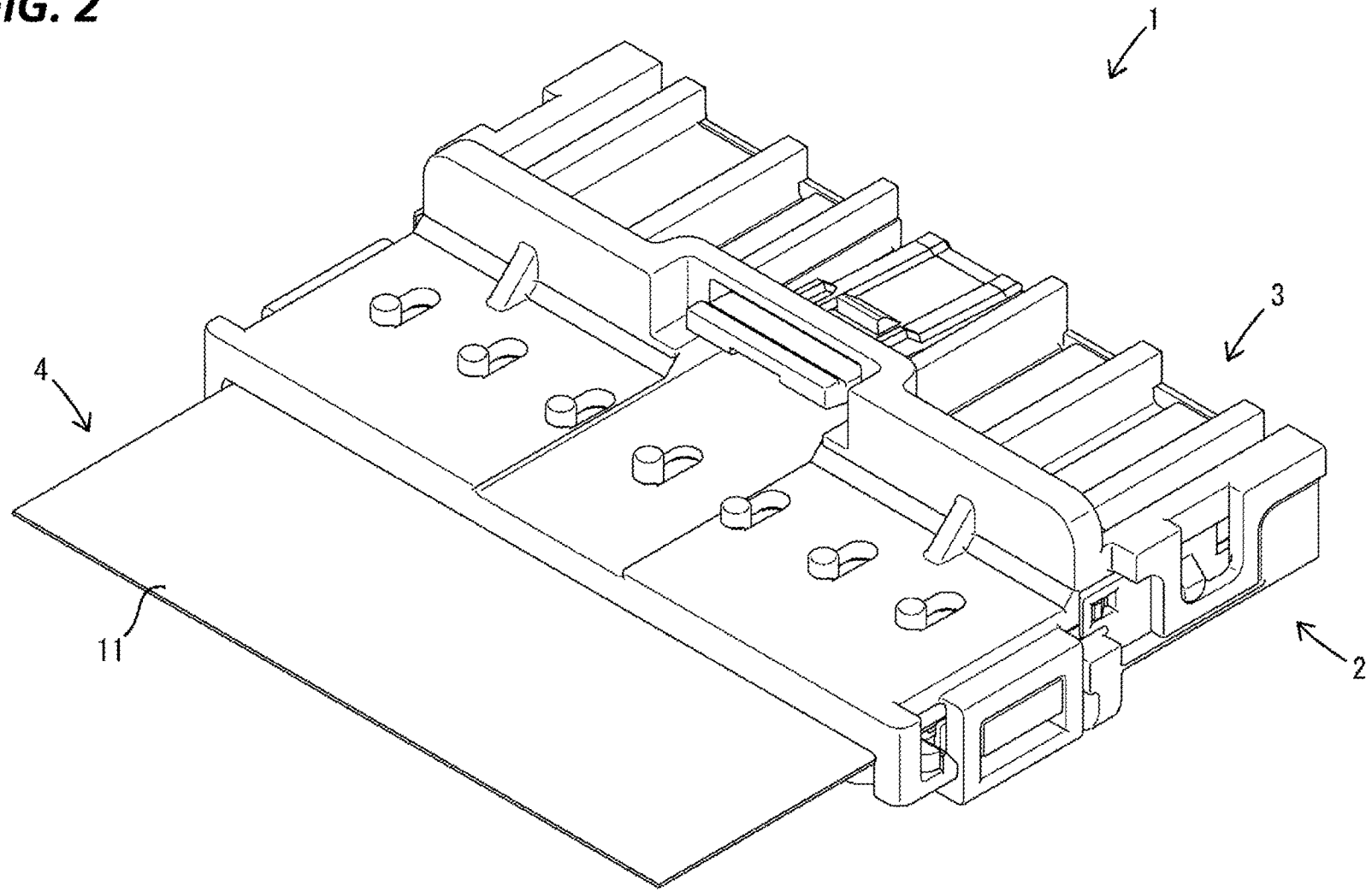
FIG. 2 is a perspective view of the connector as viewed from an upper rear side.

As shown in FIGS. 1 and 2, a connector 1 of Embodiment 1 is a connector that has a divided structure that can be divided into an upper portion and a lower portion and in which terminal accommodating chambers 5 can be divided into upper portions and lower portions due to the divided structure. The connector 1 includes a lower housing 2 on the lower side, an upper housing 3 on the upper side, and a flat cable 4 held by the housings 2 and 3 when coupled to each other. It should be noted that, in Embodiment 1, the lower housing 2 corresponds to the "first housing" of the present invention, and the upper housing 3 corresponds to the "second housing" of the present invention.

<Flat Cable 4>

Figure 3:
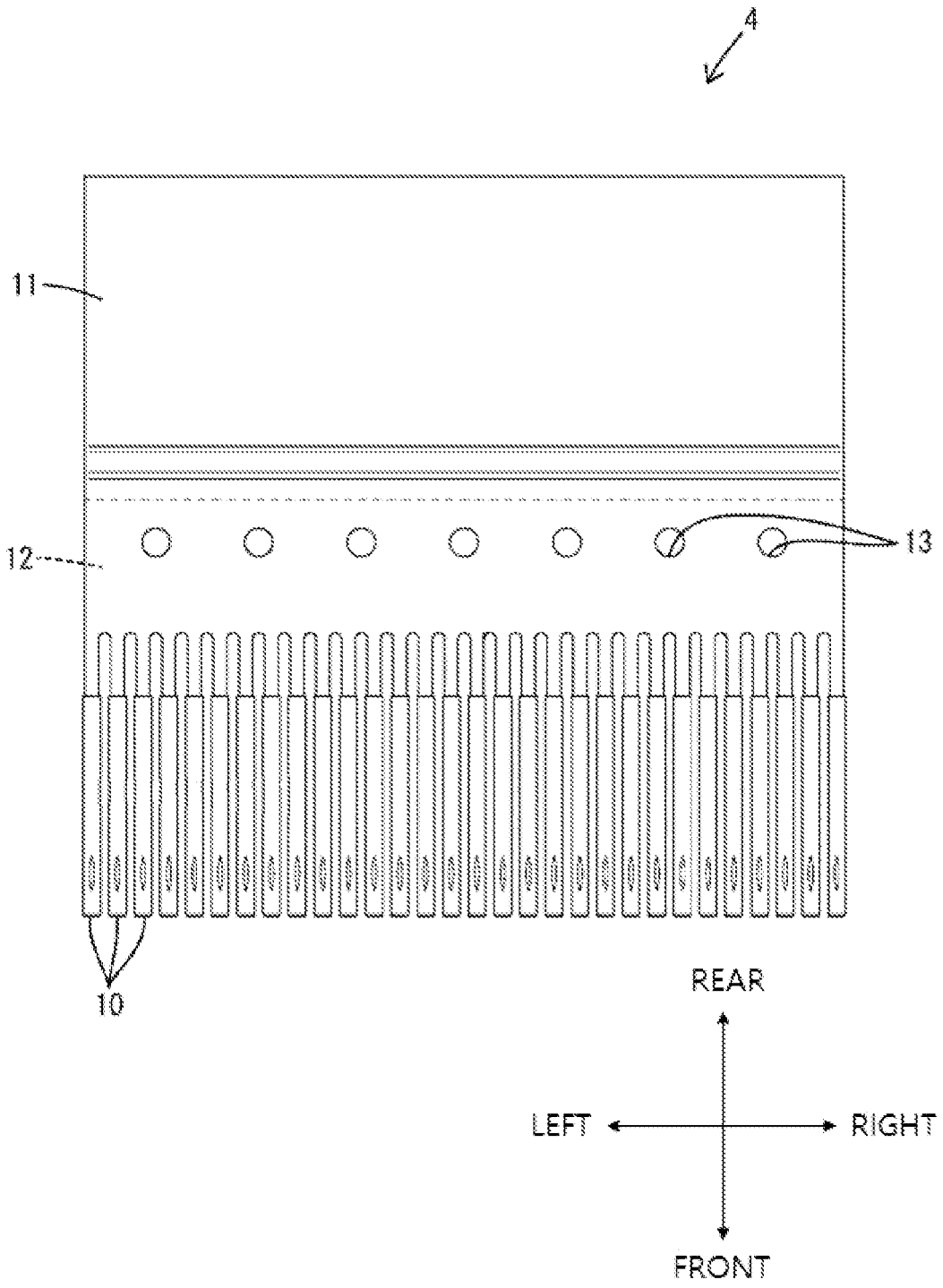
FIG. 3 is a plan view of a flat cable.
Figure 4:
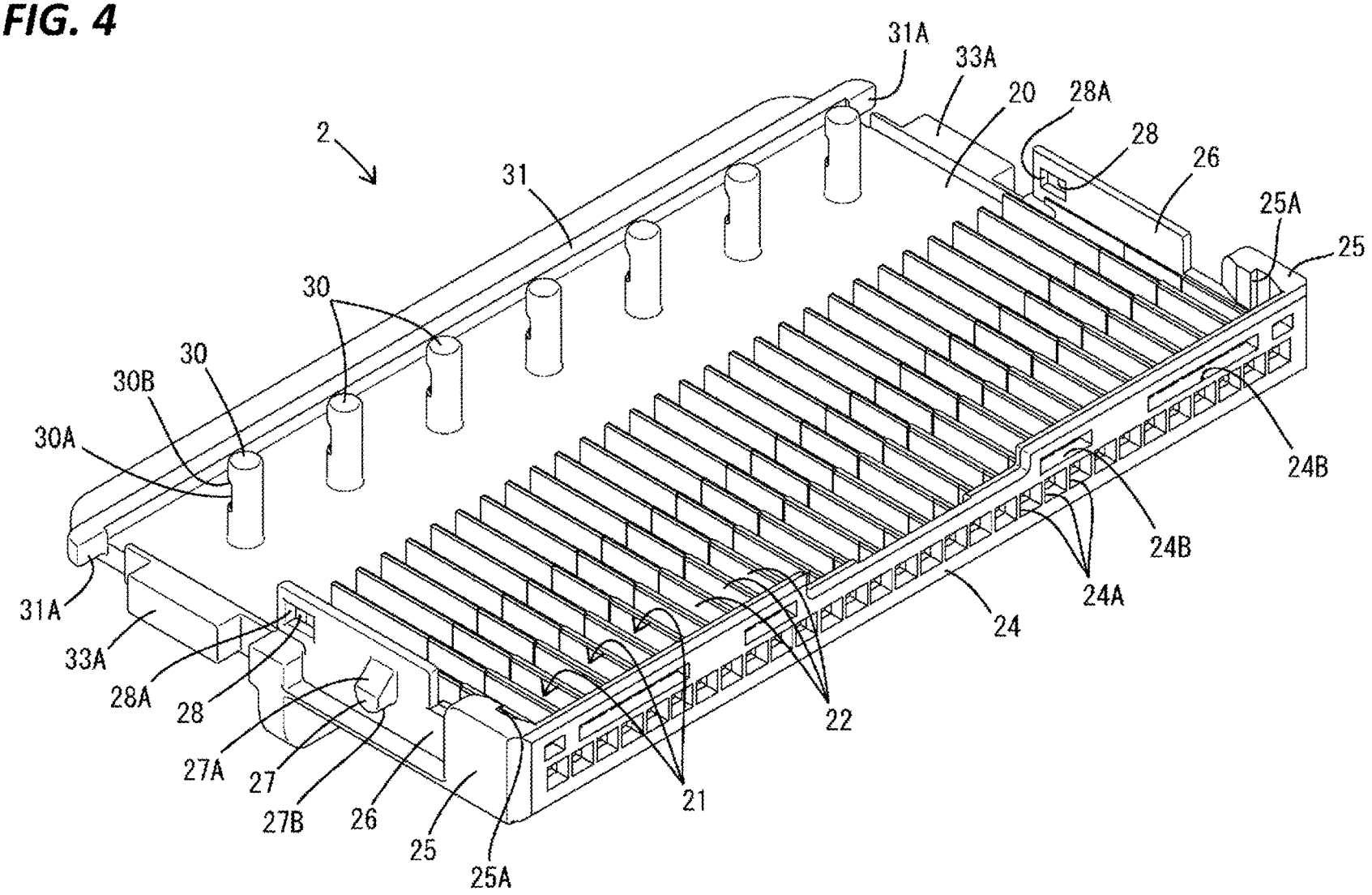
FIG. 4 is a perspective view of a lower housing as viewed from an upper front side.
Figure 5:
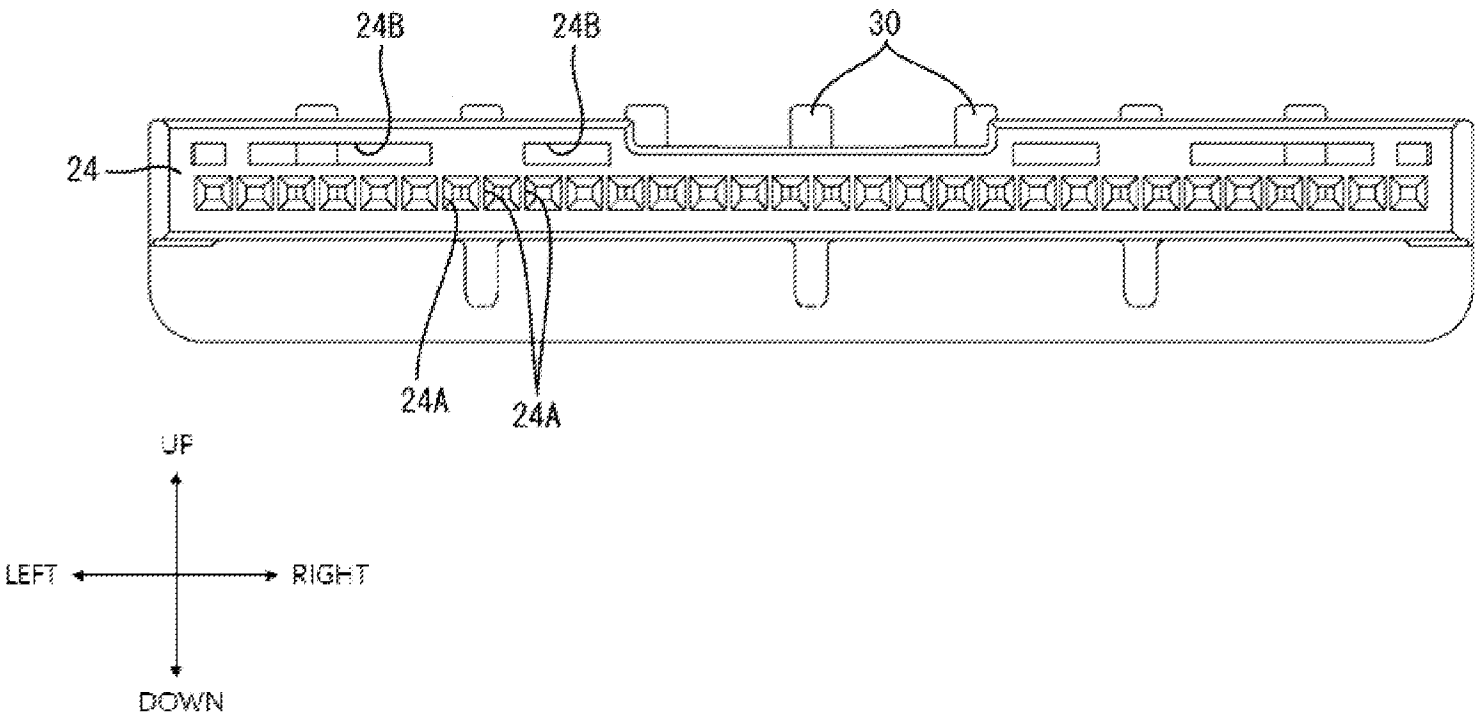
FIG. 5 is a front view of the lower housing.
Figure 6:
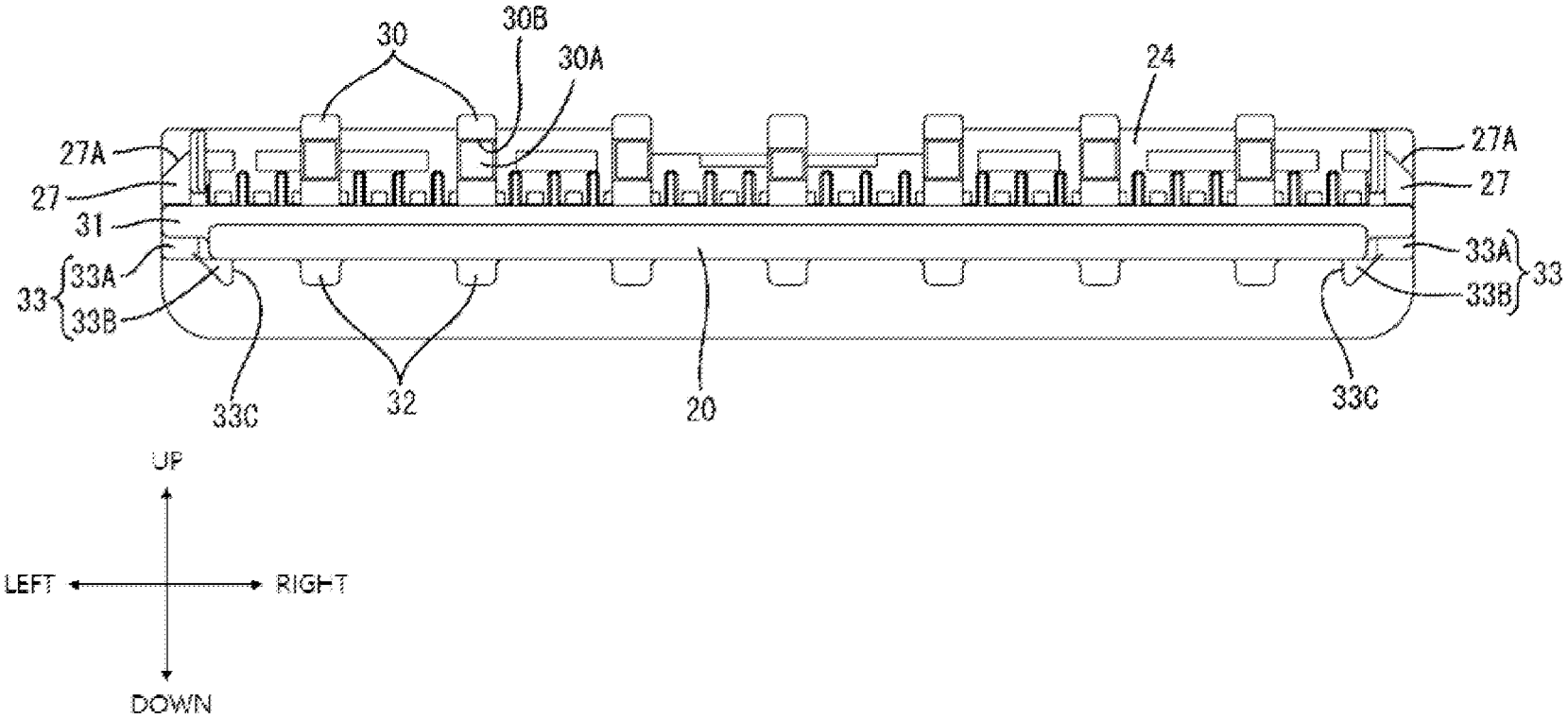
FIG. 6 is a rear view of the lower housing.
Figure 7:
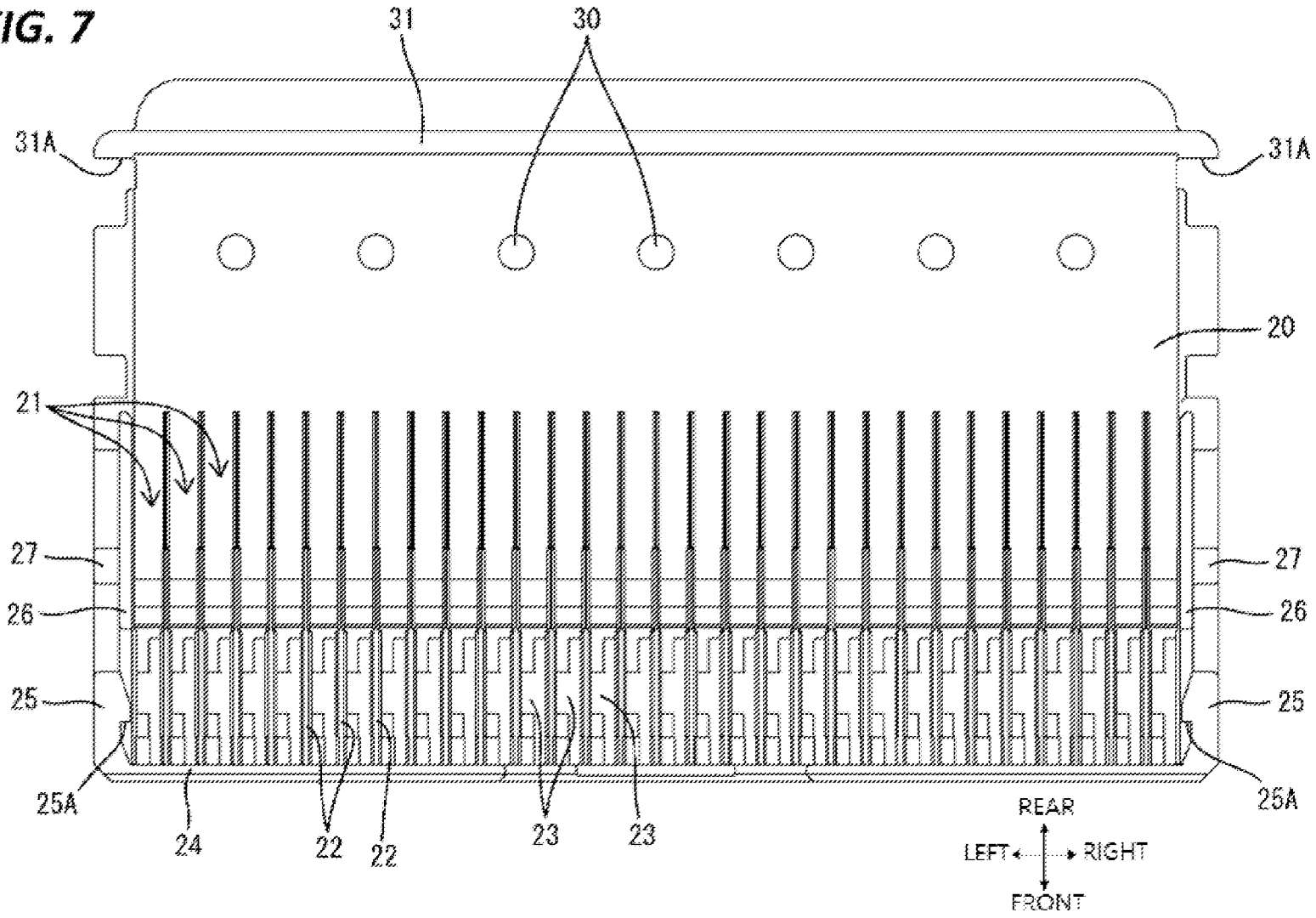
FIG. 7 is a plan view of the lower housing.
Figure 8:
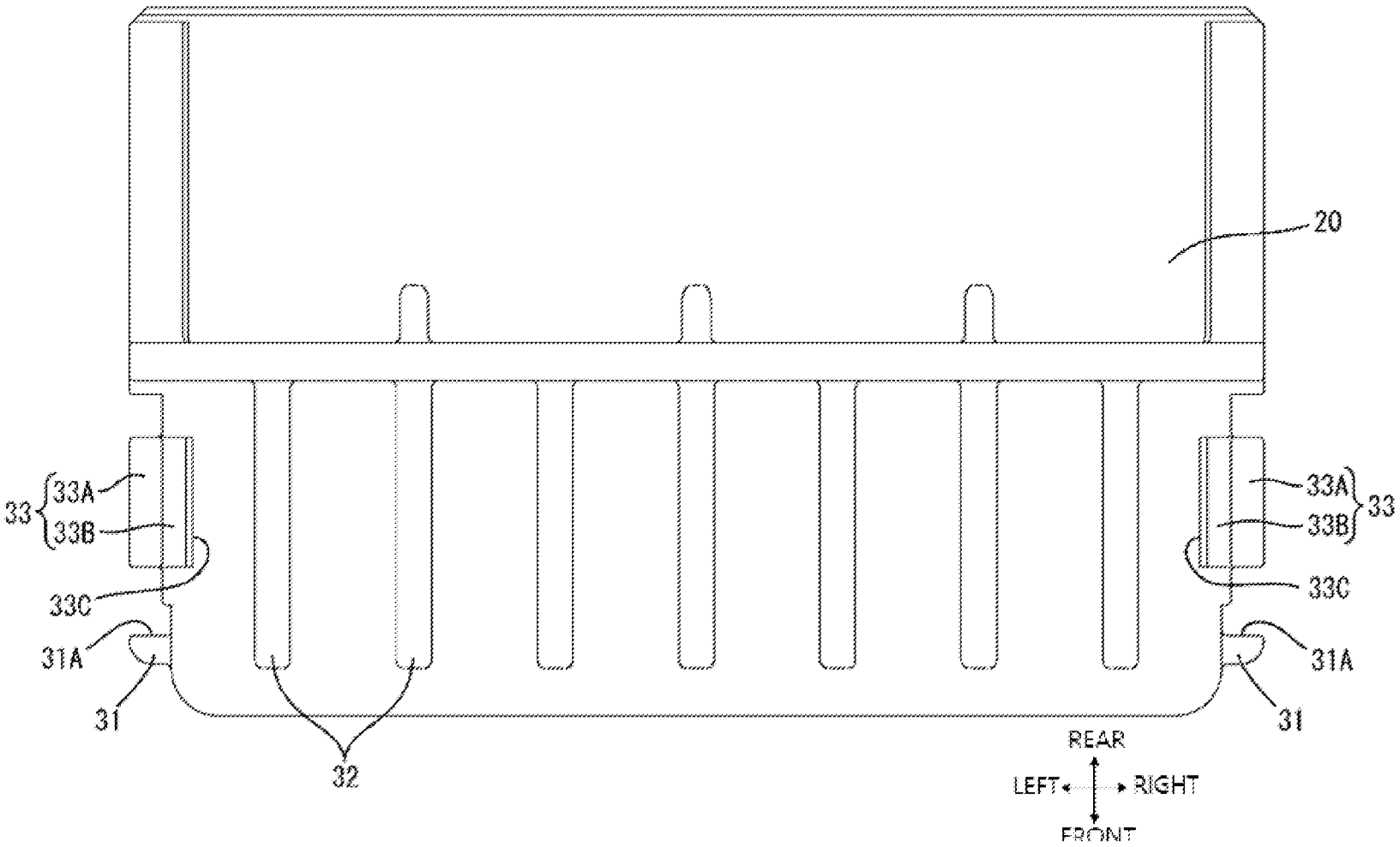
FIG. 8 is a bottom view of the lower housing.
Figure 9:
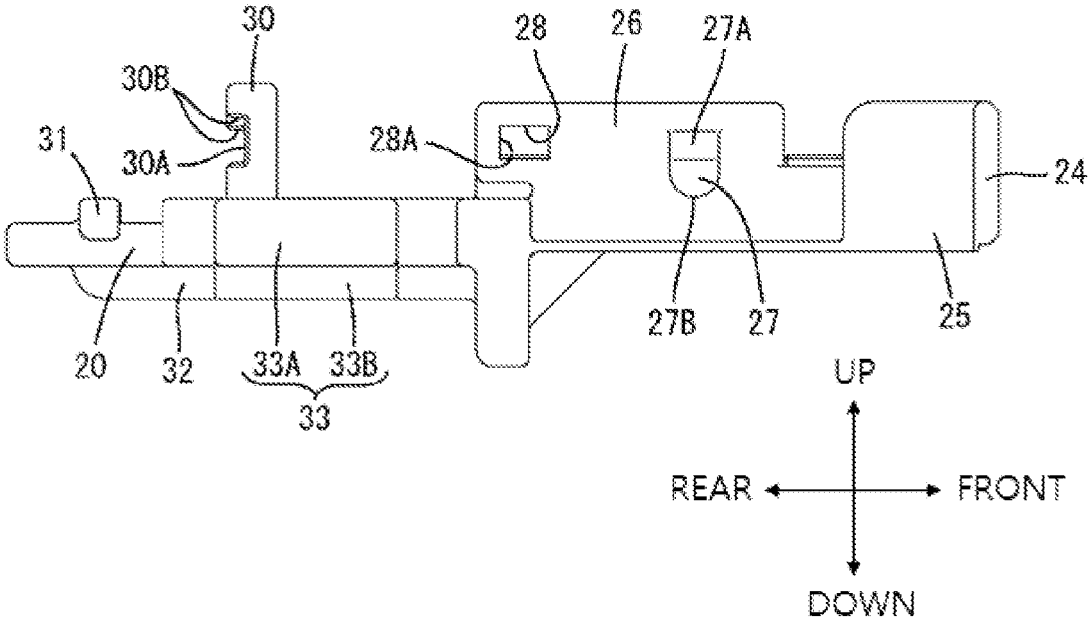
FIG. 9 is a side view of the lower housing.
Figure 10:
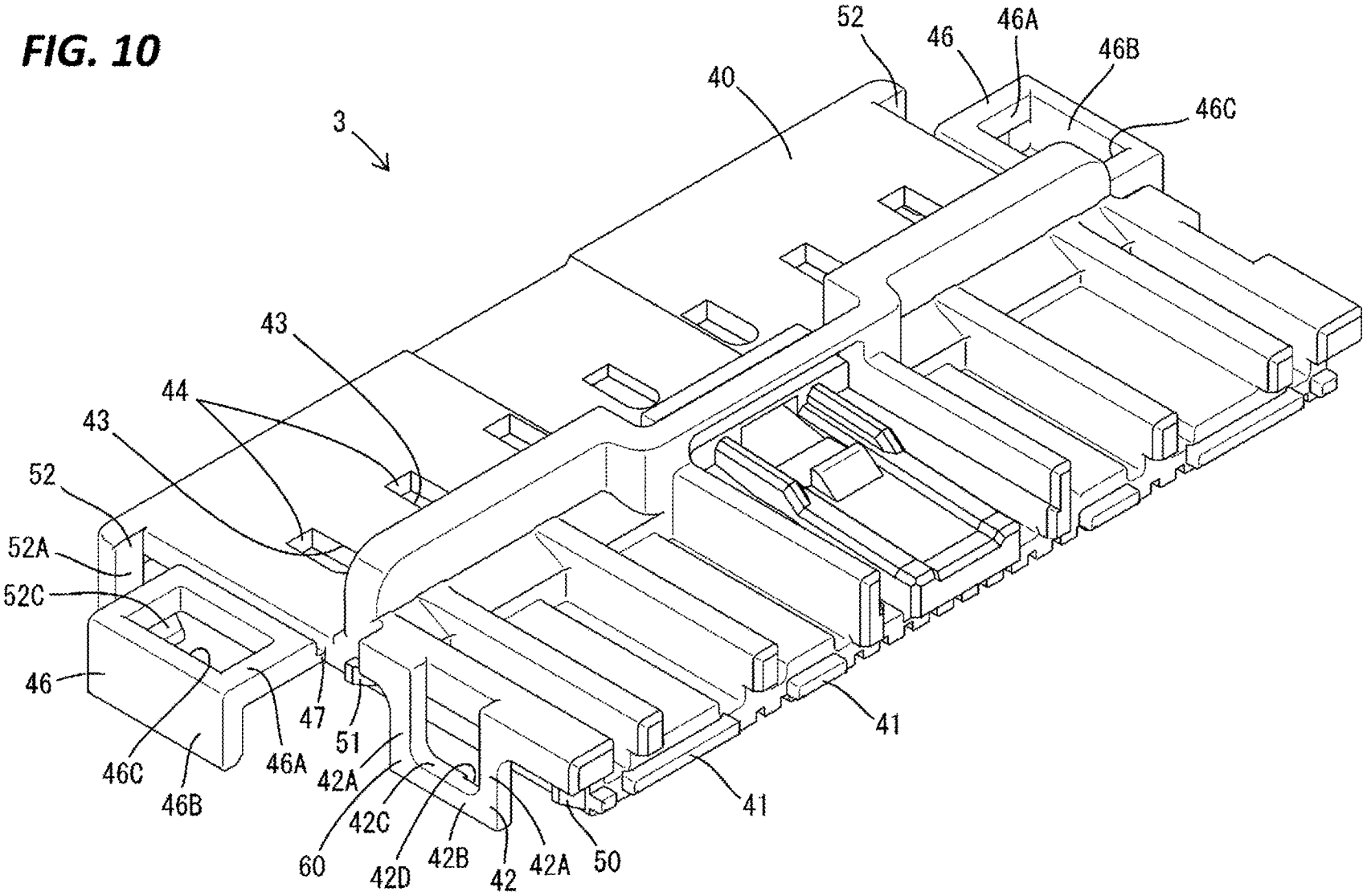
FIG. 10 is a perspective view of an upper housing as viewed from an upper front side.
Figure 11:
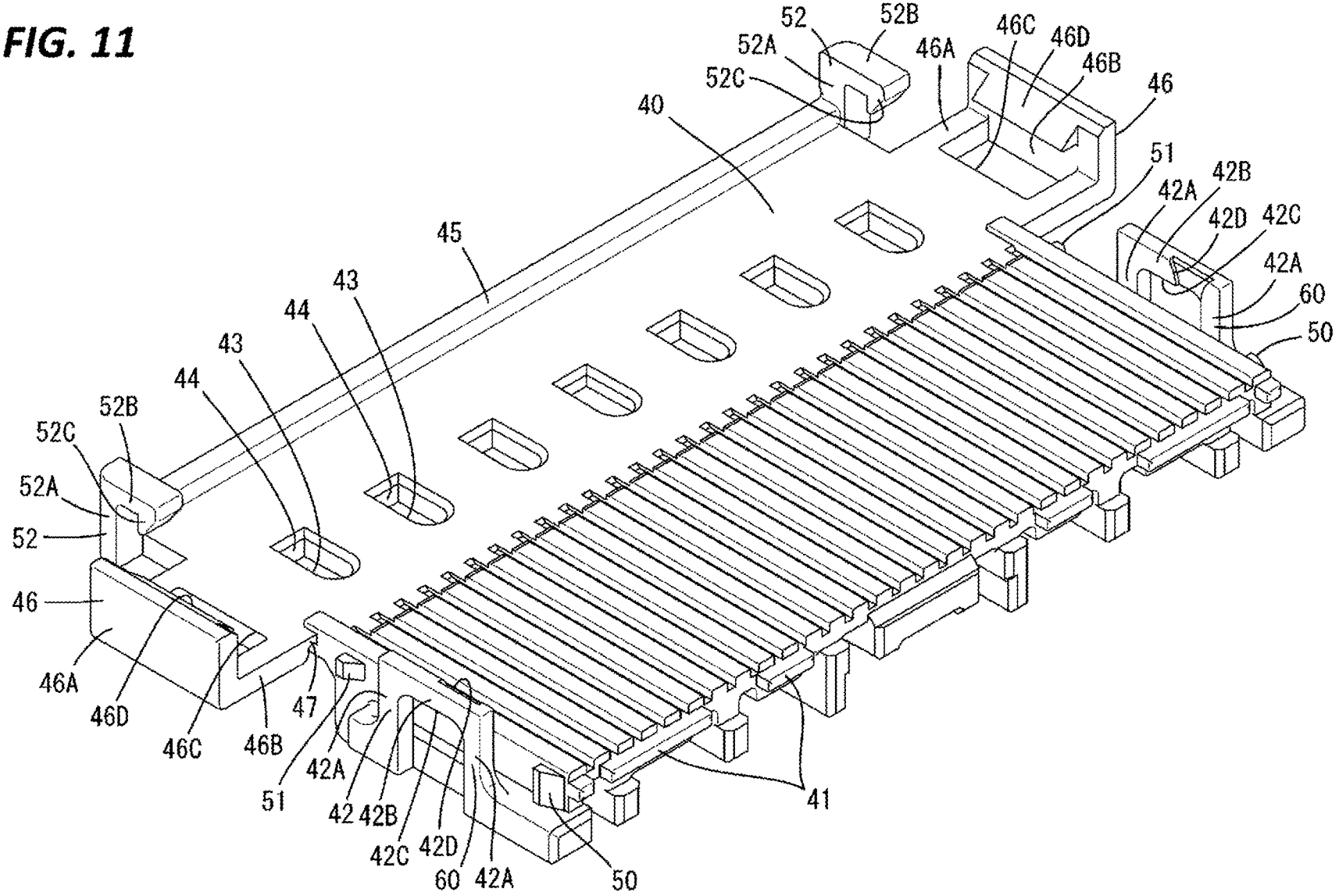
FIG. 11 is a perspective view of the upper housing as viewed from a lower front side.
Figure 12:
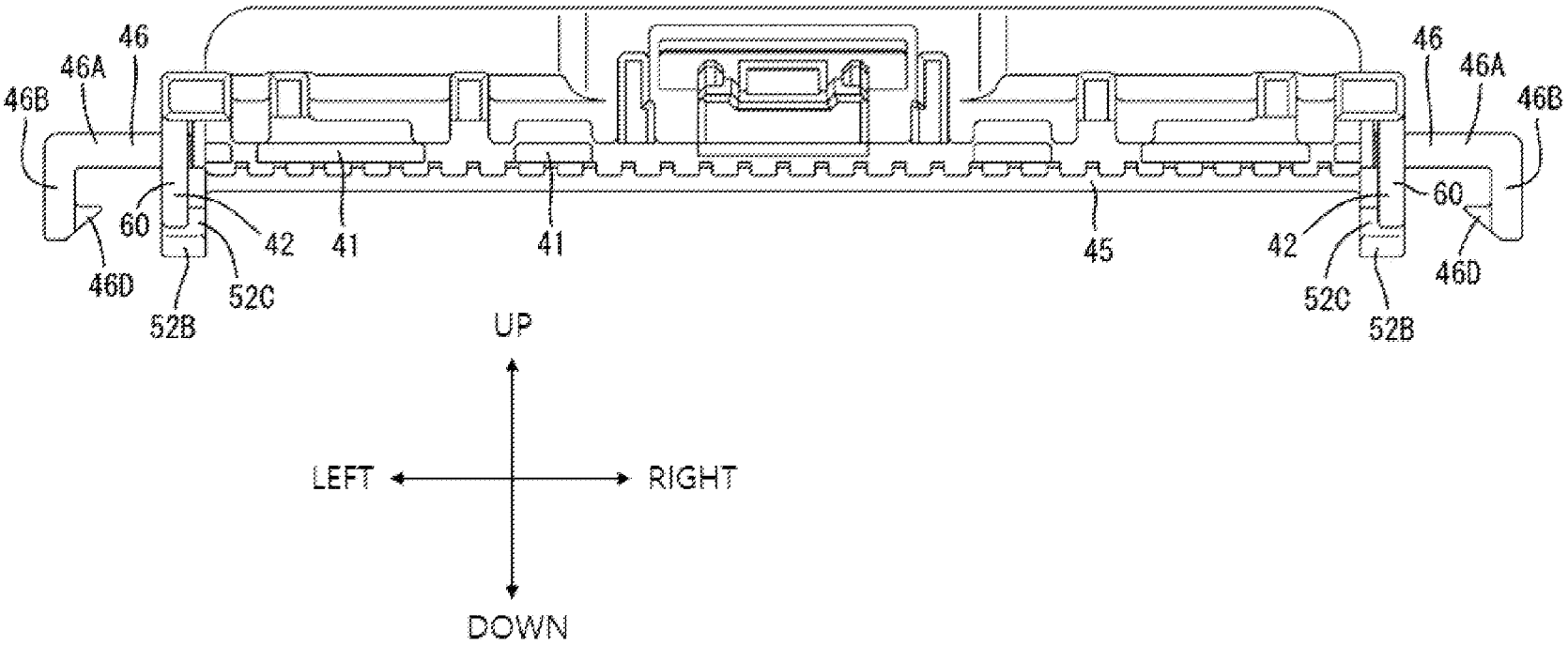
FIG. 12 is a front view of the upper housing.
Figure 13:
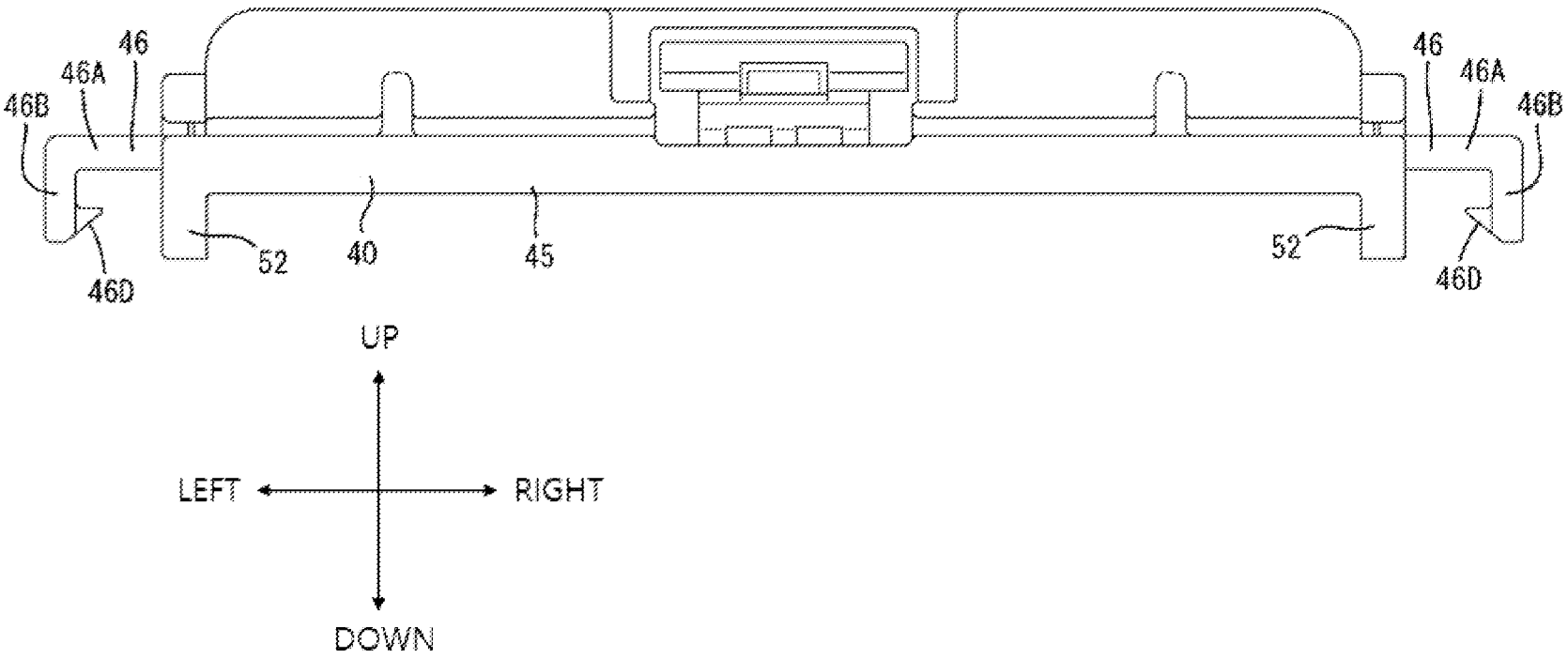
FIG. 13 is a rear view of the upper housing.
Figure 14:
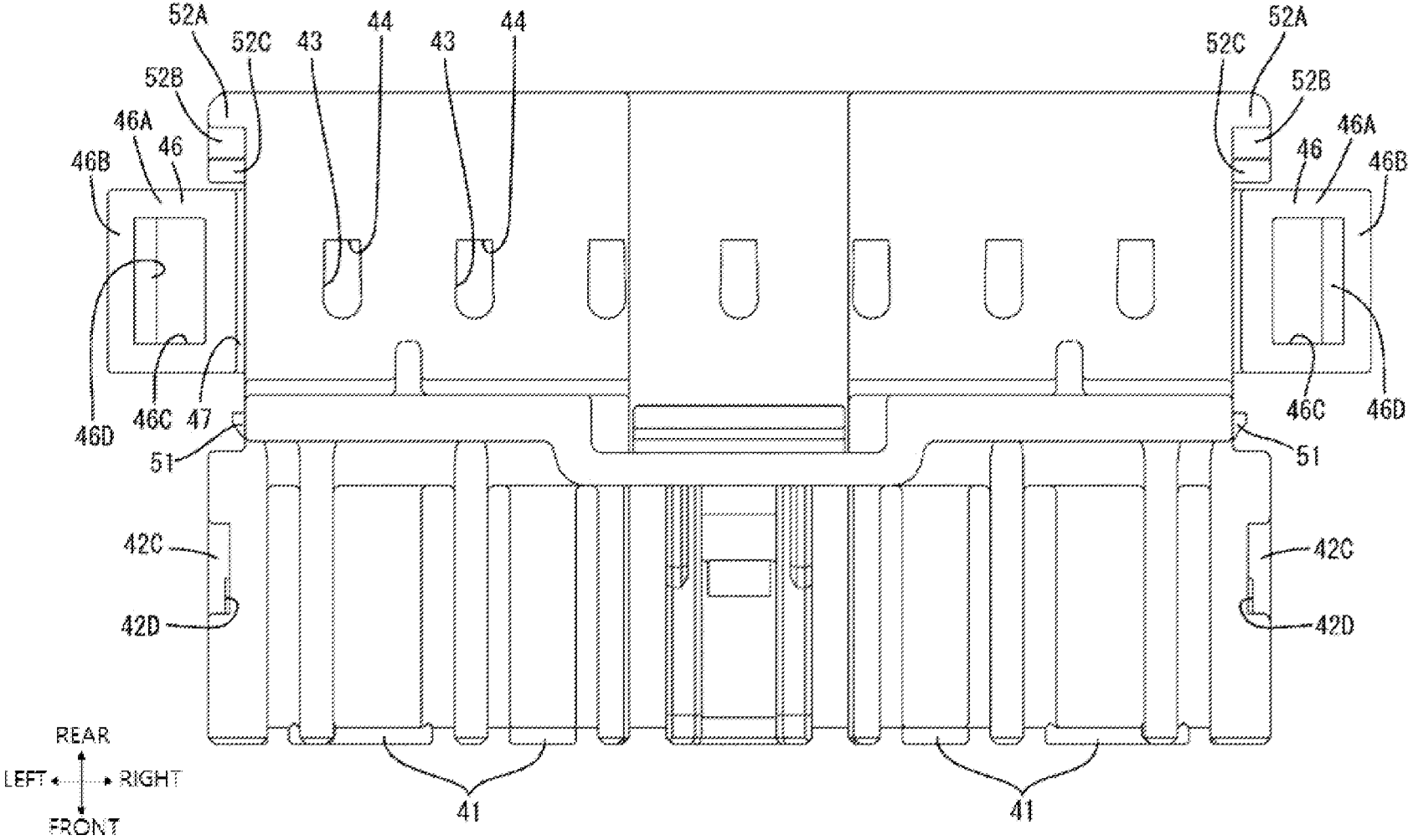
FIG. 14 is a plan view of the upper housing.
Figure 15:
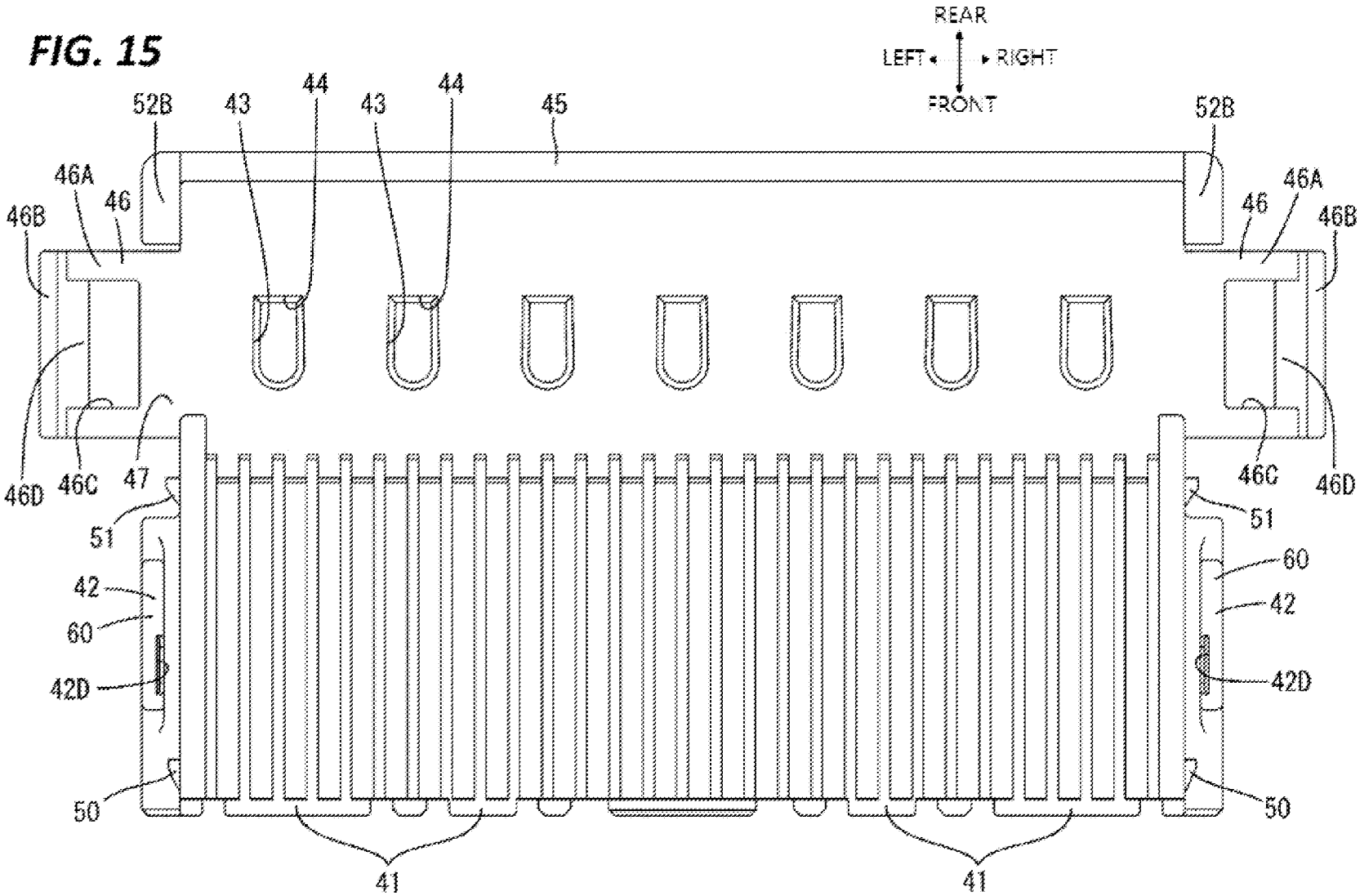
FIG. 15 is a bottom view of the upper housing.
Figure 16:
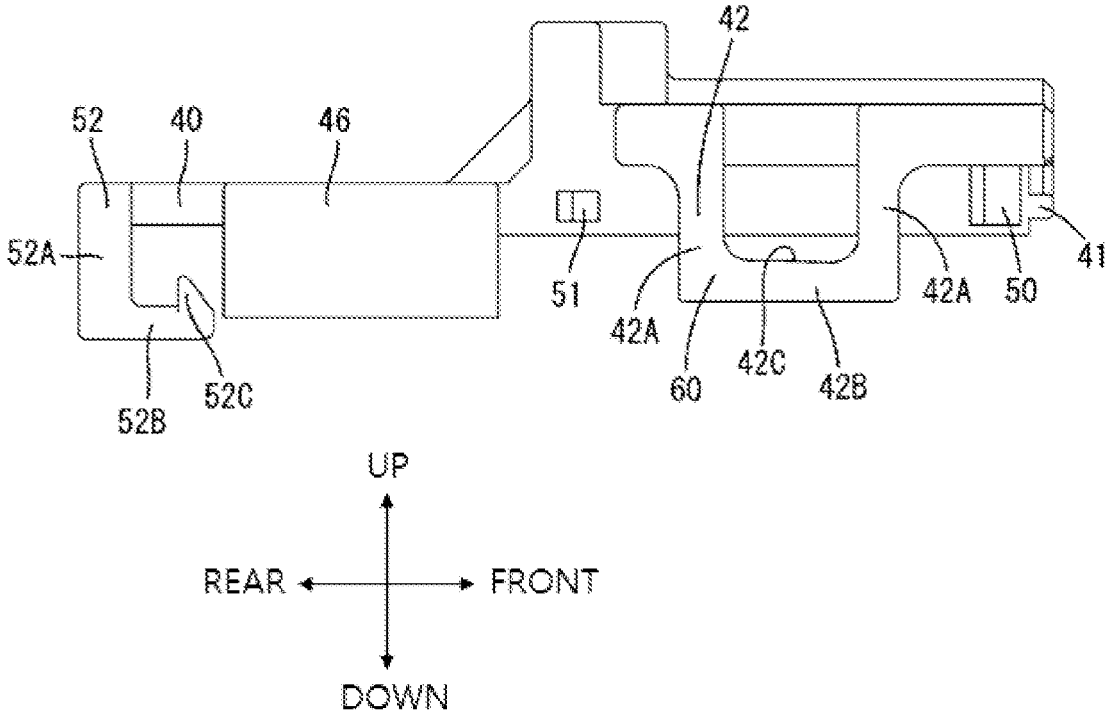
FIG. 16 is a side view of the upper housing.

For example, a flexible printed circuit, a flexible flat cable, or the like is used as the flat cable 4. As shown in FIG. 3, the flat cable 4 includes a plurality of terminal fittings 10, a plurality of conductors (not shown) that are respectively connected to the plurality of terminal fittings 10, a sheet-like member 11 that covers the plurality of conductors, and a reinforcing plate 12 that is integrated with an end portion of the sheet-like member 11 that is located near the terminal fittings 10.

Each of the terminal fittings 10 is constituted by a conductive metal member and has a shape that is elongated in the front-rear direction. The plurality of terminal fittings 10 are arranged at regular intervals so as to be lined up in the left-right direction. The conductor is connected to the rear end portion of each terminal fitting 10 through soldering or the like. All the conductors are covered by one sheet-like member 11. The sheet-like member 11 is constituted by an insulating member, and is configured to be capable of, for example, undergoing flexural deformation or being bent. The reinforcing plate 12 is attached to the underside of the sheet-like member 11. The reinforcing plate 12 is constituted by a member that is stronger than the sheet-like member 11. The reinforcing plate 12 has a substantially rectangular shape that is elongated in the left-right direction.

The width in the left-right direction of the sheet-like member 11 is the same as that of the reinforcing plate 12, and the positions of the two ends in the left-right direction and the front end of the sheet-like member 11 coincide with those of the reinforcing plate 12 in a plan view. The front end portions of the sheet-like member 11 and the reinforcing plate 12 have a comb-like shape, and the terminal fitting 10 is attached to the leading end portion of each of the comb teeth.

The flat cable 4 is provided with a plurality of (seven in Embodiment 1) reinforcing holes 13 that pass through the sheet-like member 11 and the reinforcing plate 12. The plurality of reinforcing holes 13 are lined up in row at regular intervals in the left-right direction. The plurality of reinforcing holes 13 are arranged on the rear side with respect to the base ends of the comb teeth. The reinforcing holes 13 have a circular shape. The diameter of each of the reinforcing holes 13 is substantially the same as the pitch of the terminal fittings 10 in the direction in which the terminal fittings 10 are lined up.

<Lower Housing 2>

The lower housing 2 is made of a synthetic resin and has a flat shape that is elongated in the left-right direction in a front view as shown in FIGS. 4 to 9. The lower housing 2 includes a bottom plate portion 20 having a substantially rectangular shape that is elongated in the left-right direction in a plan view. The approximate front half of the top face of the bottom plate portion 20 is provided with terminal accommodating recessed portions 21 that form the lower portions of the terminal accommodating chambers 5. The terminal accommodating recessed portions 21 have a shape that is elongated in the front-rear direction. The plurality of terminal accommodating recessed portions 21 are arranged so as to be lined up in the left-right direction. The plurality of terminal accommodating recessed portions 21 are separated from each other by a plurality of partition walls 22 that protrude from the top face of the bottom plate portion 20 and extend in the front-rear direction. The terminal fitting 10 can be accommodated in each of the terminal accommodating recessed portions 21 from the rear side or from above, and rearward movement of the terminal fitting 10 accommodated in the terminal accommodating recessed portion 21 is restricted by a lance 23 provided in the lower portion of the terminal accommodating recessed portion 21.

The lower housing 2 includes a front wall portion 24 having a plate-like shape that protrudes upward from the front end of the top face of the bottom plate portion 20 and extends in the left-right direction. The front wall portion 24 is formed over the entire width of the lower housing 2 in the left-right direction. Forward movement of the terminal fitting 10 accommodated in the terminal accommodating recessed portion 21 is restricted by the front wall portion 24. The front face of the front wall portion 24 is provided with first openings 24A at positions corresponding to the terminal accommodating recessed portions 21. When counterpart terminal fittings (not shown) enter the terminal accommodating recessed portions 21 through the first openings 24A, they are electrically connected to the terminal fittings 10 in the terminal accommodating recessed portions 21.

The front wall portion 24 is provided with a plurality of fitting holes 24B that are located above the first openings 24A and pass through the front wall portion 24 in the front-rear direction. The fitting holes 24B have a shape that is elongated in the left-right direction. Fitting portions 41 of the upper housing 3, which will be described later, are to be fitted into the fitting holes 24B.

The lower housing 2 includes two side wall portions 25 that protrude upward from the left and right ends of the top face of the bottom plate portion 20 and extend in the front-rear direction. The front end edges of the side wall portions 25 are continuous with the left and right end edges of the front wall portion 24. A stepped portion is formed on the inner face of each of the side wall portion 25, and is provided with a first assembling locking portion 25A that extends in the horizontal direction. A space in which the first assembling portion 50, which will be described later, is accommodated is formed on the front side of each of the first assembling locking portions 25A.

The lower housing 2 includes, on the rear side of the two side wall portions 25, two side plate portions 26 that protrude upward from the left and right ends of the top face of the bottom plate portion 20 and extend in the front-rear direction. The rear end edges of the side plate portions 26 are substantially aligned with the rear end edges of the partition walls 22 (the rear end edges of the terminal accommodating recessed portions 21) in the front-rear direction. Each of the side plate portions 26 is provided with a protruding piece portion 27 having a protruding shape that protrudes outward in the left-right direction from the outer face in the left-right direction. The top portion (a portion on the upper housing 3 side) of each of the protruding piece portions 27 is provided with a guide face 27A that is inclined downward (in a direction toward a side opposite to the upper housing 3 side) and outward in the left-right direction. The bottom portion (a portion on a side opposite to the upper housing 3 side) of each of the protruding piece portions 27 is provided with a locking portion 27B that is curved so as to project downward in a side view.

Each of the side plate portions 26 is provided with a side face through hole 28 that passes through the side plate portion 26 in the left-right direction at a position located on the rear side with respect to the protruding piece portion 27. The rear face of each of the side face through holes 28 is provided with a second assembling locking portion 28A on which a second assembling portion 51, which will be described later, is hooked.

A plurality of (seven in Embodiment 1) pins 30 having a substantially cylindrical shape rise from the top face of the bottom plate portion 20. The plurality of pins 30 are arranged on the rear side with respect to the rear end edges of the terminal accommodating recessed portions 21 and are lined up in a row at regular intervals in the left-right direction. The rear face of each of the pins 30 is provided with a fitting recessed portion 30A, and the top face of the fitting recessed portion 30A is provided with a pin restriction portion 30B that extends in the horizontal direction. The pin restriction portion 30B of the central pin 30 of the plurality of pins 30 is located below those of the other pins 30. The number of the above-described reinforcing holes 13 of the flat cable 4 is larger than the number of the pins 30, and the reinforcing holes 13 are arranged at positions corresponding to all the pins 30.

The bottom plate portion 20 is provided with, at a position on the rear side with respect to the rear ends of the plurality of pins 30, a lower rib 31 that protrudes upward from the top face and extends in the left-right direction. The left and right ends of the lower rib 31 protrude outward in the left-right direction from the left and right ends of the bottom plate portion 20. The front faces of the left and right end edges (portions on the outside in the left-right direction with respect to the left and right ends of the bottom plate portion 20) of the lower rib 31 are provided with third assembling locking portions 31A that extend in the vertical direction. Third assembling portions 52, which will be described later, are to be hooked on the third assembling locking portions 31A.

The bottom plate portion 20 is provided with a plurality of reinforcing ribs 32 that protrude downward from the bottom face and extend in the front-rear direction. The reinforcing ribs 32 are arranged so as to pass just below the pins 30.

Two hook portions 33 are formed at the left and right ends of the bottom plate portion 20. Each of the hook portions 33 includes an assembly detection rib 33A having a block shape that protrudes outward in the left-right direction from the left or right end face of the bottom plate portion 20, and a non-swinging locking protrusion 33B that protrudes downward from the left or right end edge of the bottom face of the bottom plate portion 20 and extends in the front-rear direction.

The assembly detection ribs 33A are formed such that the length in the front-rear direction is larger than the height. The assembly detection rib 33A are arranged on the rear side with respect to the side plate portions 26 and on the front side with respect to the lower rib 31.

The front ends of the non-swinging locking protrusions 33B are aligned with the front ends of the assembly detection ribs 33A in the front-rear direction, and the rear ends of the non-swinging locking protrusions 33B are aligned with the rear ends of the assembly detection ribs 33A in the front-rear direction. The downward projection dimensions of the non-swinging locking protrusions 33B gradually increase inward the left-right direction. The inner face of each of the non-swinging locking protrusions 33B is provided with a hook face 33C that extends in the vertical direction.

<Upper Housing 3>

The upper housing 3 is made of a synthetic resin and has a flat shape that is elongated in the left-right direction in a front view as shown in FIGS. 10 to 16. The upper housing 3 includes a top plate portion 40 having a substantially rectangular shape that is elongated in the left-right direction in a plan view. The top plate portion 40 is provided with a plurality of fitting portions 41 that protrude forward from the front end face.

Two elastic locking pieces 42 are provided at the left and right end edges of the top plate portion 40 at positions on the front side with respect the center in the front-rear direction of the top plate portion 40. The upper housing 3 is provided with protruding piece restriction portions 60 for restricting the movement of the protruding piece portions 27. In this embodiment, the elastic locking pieces 42 serve as the protruding piece restriction portions 60. Each of the elastic locking pieces 42 extends downward from the top plate portion 40 and has a cantilever shape. Specifically, each of the elastic locking piece 42 includes two vertical shaft portions 42A that extend downward from the top plate portion 40, and a horizontal shaft portion 42B that connects the lower end edges of the two vertical shaft portions 42A. The top face of each of the horizontal shaft portion 42B is provided with an inclined face 42C that is inclined downward toward the front side. The inner face in left-right direction of each of the horizontal shaft portion 42B is provided with a lock positioning portion 42D having a recessed shape.

The top plate portion 40 is provided with a plurality of (seven) relief holes 43 that pass through the top plate portion 40 in the vertical direction at positions on the rear side with respect to the center in the front-rear direction of the top plate portion 40. The relief holes 43 have a shape that is elongated in the front-rear direction in a plan view. The front end portion of each of the relief holes 43 has a curved shape in a plan view, whereas the rear end portion has an angular shape. The plurality of relief holes 43 are lined up in a row at regular intervals in the left-right direction. A portion of the top face of the top plate portion 40 that is provided with the central relief hole 43 of the plurality of relief holes 43 is recessed from portions provided with the other relief holes 43. The plurality of relief holes 43 are arranged at positions corresponding to the plurality of pins 30. The widths in the left-right direction of the relief holes 43 are larger than the widths in the left-right direction (diameters) of the pins 30.

The top plate portion 40 is provided with an upper rib 45 that protrudes downward from the rear end edge of the bottom face and extends in the left-right direction. The upper rib 45 is formed over the entire width of the top plate portion 40.

Two swinging locking portions 46 are provided at the left and right end edges of the top plate portion 40 at positions on the rear side with respect to the center in the front-rear direction of the top plate portion 40. Each of the swinging locking portions 46 can swing about a hinge 47 that connects the swinging locking portion 46 and the top plate portion 40 and serves as a swing axis. The hinges 47 are formed so as to extend in the front-rear direction along the left and right end edges of the top plate portion 40. When external force is not applied, each of the swinging locking portions 46 has a substantially L-shape that extends outward in the left-right direction and bends downward, in a front view. Each of the swinging locking portions 46 has a rectangular shape that is elongated in the front-rear direction in a plan view and has a rectangular shape that is elongated in the front-rear direction in a side view. In the following description, a portion of each of the swinging locking portion 46 that extends outward in the left-right direction is referred to as "base end plate portion 46A", and a portion of each of the swinging locking portion 46 that bends downward is referred to as "leading end plate portion 46B". Each of the base end plate portion 46A is provided with a second opening 46C that is large in size and is open in the thickness direction of the base end plate portion 46A. The leading end edge portion of each of the leading end plate portions 46B is provided with a swinging locking protrusion 46D that protrudes in the thickness direction of the leading end plate portion 46B from the face on the hinge 47 side and extends in the front-rear direction. The front end edges of the swinging locking portions 46 are located on the front side with respect to the front end edges of the relief holes 43, and the rear end edges of the swinging locking portions 46 are located on the rear side with respect to the rear end edges of the relief holes 43.

The top plate portion 40 is provided with two first assembling portions 50 that protrude outward in the left-right direction from the left and right end faces. The two first assembling portions 50 are arranged at the front end portion of the top plate portion 40, and are arranged at positions on the front side with respect to the front ends of the elastic locking pieces 42.

The top plate portion 40 is provided with two second assembling portions 51 that protrude outward in the left-right direction from the left and right end faces. The two second assembling portions 51 are arranged at the center in the front-rear direction of the top plate portion 40. The two second assembling portions 51 are arranged at positions on the rear side with respect to the rear edges of the elastic locking pieces 42. The two second assembling portions 51 are arranged at positions on the front side with respect to the front edges of the swinging locking portions 46.

Two third assembling portions 52 are provided at the left and right end edges of the upper rib 45. Each of the two third assembling portions 52 includes a base end side arm portion 52A that extends downward from a position located on the outside in the left-right direction with respect to the left or right end of the top plate portion 40, a leading end side arm portion 52B that extends forward from the lower end edge (leading end) of the base end side arm portion 52A, and a protrusion 52C that protrudes upward from the top face of the front end portion (leading end portion) of the leading end side arm portion 52B.

<Assembly of Housings 2 and 3>

The lower housing 2 and the upper housing 3 are coupled to each other so as to be brought into a coupled state. Furthermore, the lower housing 2 and the upper housing 3 are moved relative to each other in a predetermined assembly direction intersecting the coupling direction to be brought into an assembled state. The following specifically describes this coupling.

Figure 17:
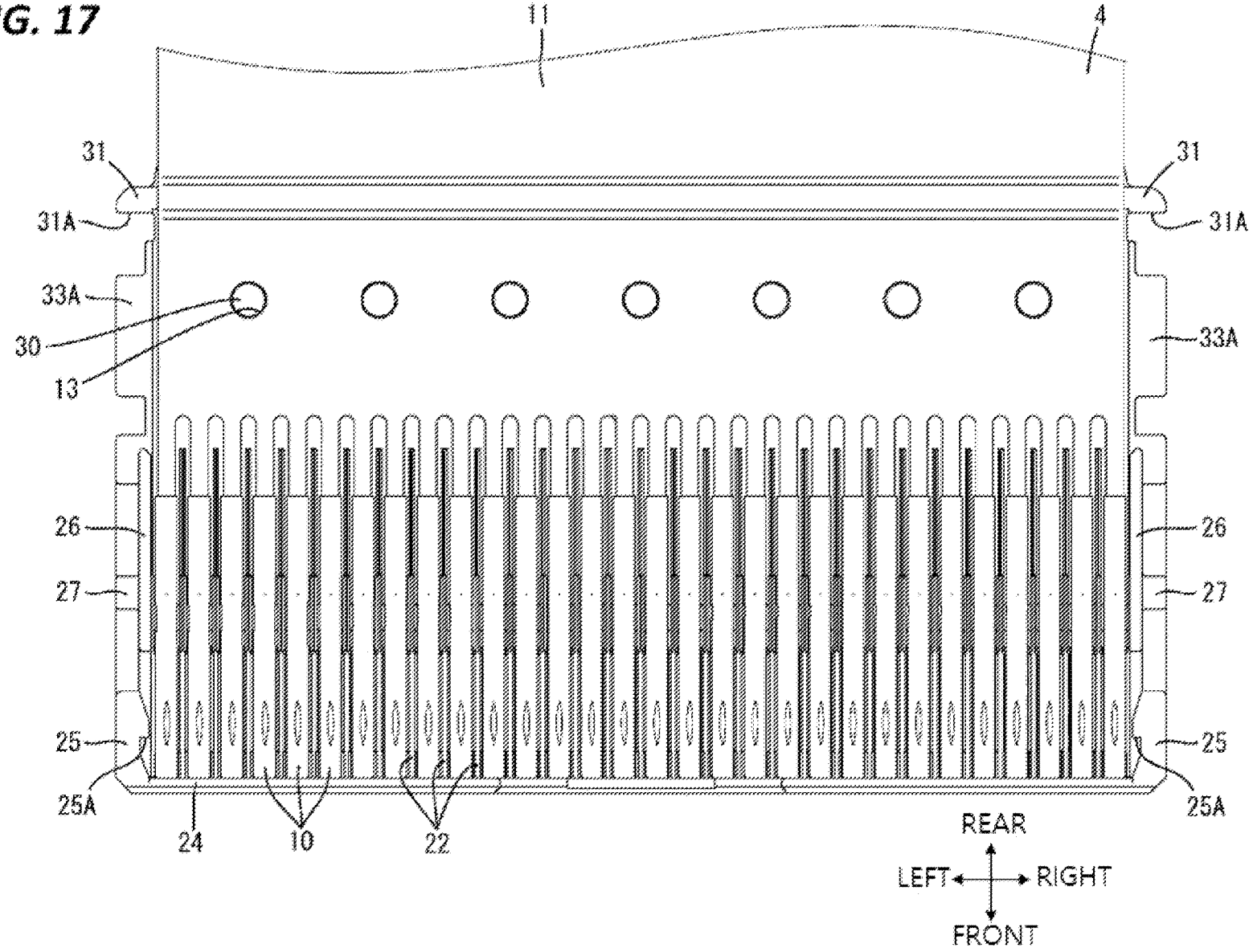
FIG. 17 is a plan view showing a state in which the flat cable is placed on the top face of the lower housing.

First, as shown in FIG. 17, the flat cable 4 is placed on the top face of the lower housing 2. At this time, the terminal fittings 10 of the flat cable 4 are accommodated in the terminal accommodating recessed portions 21, and the lance 23 is used to prevent rearward dislodgement of the terminal fittings 10. The pins 30 are inserted into the reinforcing holes 13 of the flat cable 4. Accordingly, when the sheet-like member 11 is pulled rearward, the reinforcing holes 13 are caught on the pins 30, and therefore, it is possible to prevent pulling force from being applied to the connection portions where the terminal fittings 10 are connected to the conductors, thus making it possible to prevent the connection portions from being damaged where the terminal fittings 10 are connected to the conductors. In the state in which the flat cable 4 is placed on the top face of the lower housing 2, the rear end of the reinforcing plate 12 is arranged at a position on the front side with respect to the front end of the lower rib 31. Accordingly, a portion to which the reinforcing plate 12 is not attached (including only the sheet-like member 11 and the conductors) is placed on the top face of the lower rib 31.

Figure 18:
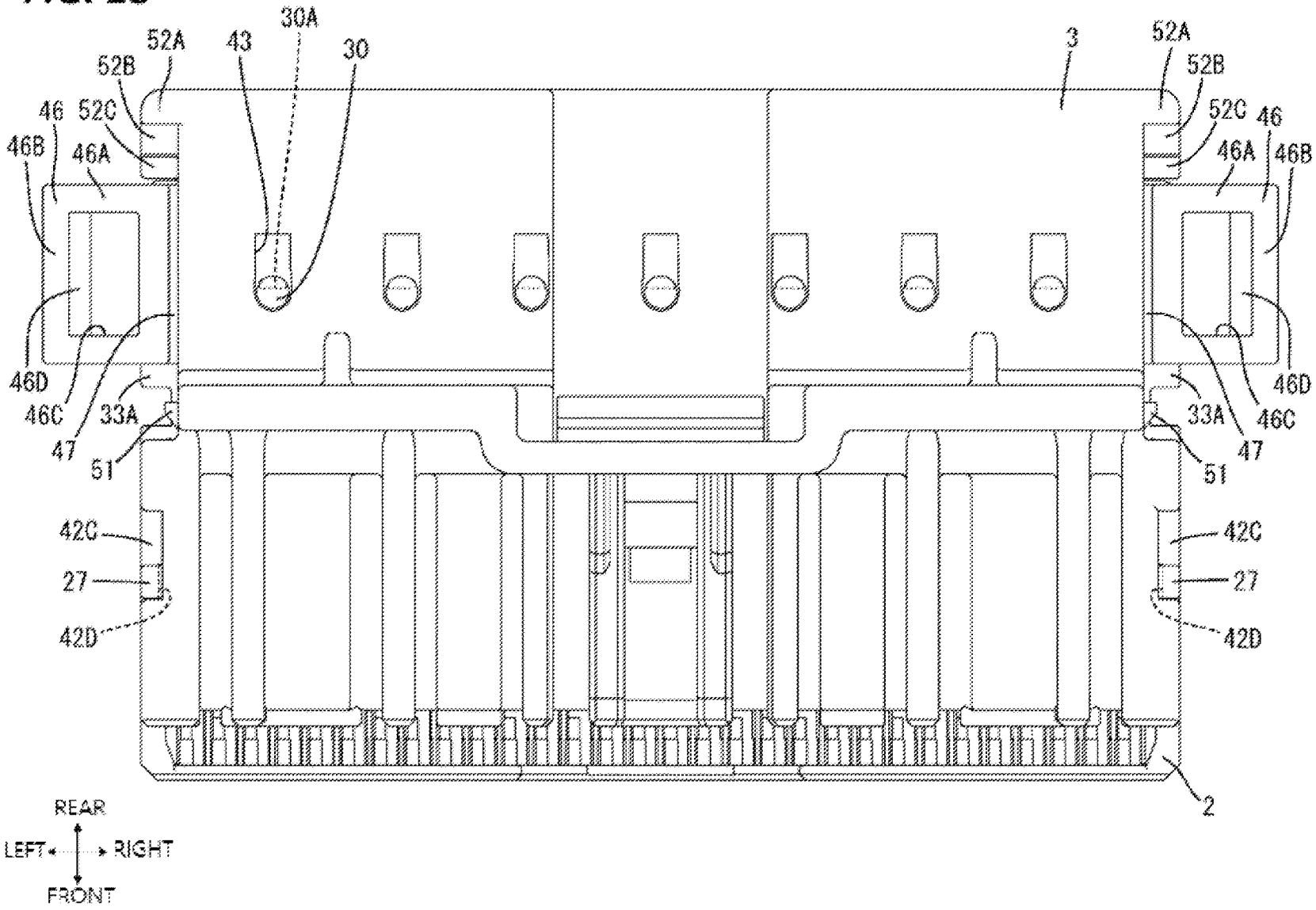
FIG. 18 is a plan view showing a state in which the lower housing and the upper housing are coupled.
Figure 19:
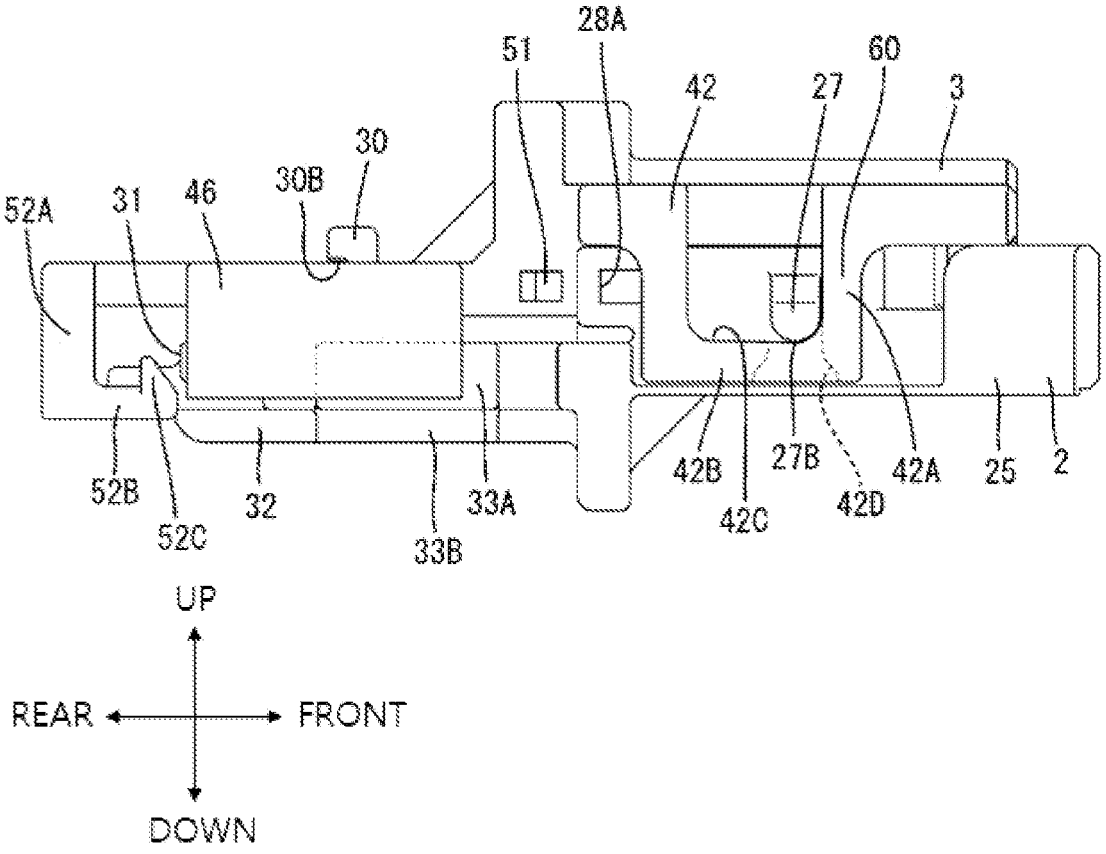
FIG. 19 is a side view showing the state in which the lower housing and the upper housing are coupled.

Thereafter, as shown in FIGS. 18 and 19, the upper housing 3 is coupled to the lower housing 2 from above. At this time, the lower housing 2 and the upper housing 3 are coupled to each other in a state in which the lower housing 2 and the upper housing 3 are positioned such that the two protruding piece portions 27 are aligned with the two lock positioning portions 42D in the front-rear direction (assembly direction). This makes it possible to prevent the lower housing 2 and the upper housing 3 from unnecessarily interfering with each other and thus, for example, being damaged. In the process of coupling the lower housing 2 and the upper housing 3, the two elastic locking pieces 42 are pressed outward in the left-right direction by the protruding piece portions 27 and are thus elastically deformed and inclined. The two elastic locking pieces 42 are elastically restored while swinging about the fixed ends serving as swing axes when the interference of the protruding piece portions 27 are removed. With this configuration, the locking portions 27B of the protruding piece portions 27 restrict the movement of the elastic locking pieces 42 in the direction in which the lower housing 2 and the upper housing 3 are separated from each other. The state in which the lower housing 2 and the upper housing 3 are coupled to each other and thus movement thereof is restricted in the direction in which the lower housing 2 and the upper housing 3 are separated from each other is referred to as the "coupled state".

Also, in the process of coupling the lower housing 2 and the upper housing 3, the pins 30 are inserted into the relief holes 43 of the upper housing 3. When the lower housing 2 and the upper housing 3 are coupled to each other, the pins 30 protrude upward from the upper ends of the relief holes 43.

The elastic locking pieces 42 are elastically restored from the inclined orientation while swinging about the fixed ends serving as swing axes. Accordingly, in the coupled state, gaps are formed between the inclined surfaces 42C of the elastic locking pieces 42 and the locking portions 27B of the protruding piece portions 27, and this causes looseness of the housings 2 and 3. Therefore, in the connector 1, it is possible to suppress looseness as described below.

After having been coupled to each other, the lower housing 2 and the upper housing 3 are moved relative to each other in a predetermined assembly direction intersecting the coupling direction and are thus assembled. The state of the lower housing 2 and the upper housing 3 is as follows before they are brought into the assembled state, that is, when they are in the coupled state. Each of the protruding piece portions 27 is located above the inclined surface 42C and on the front side with respect to the center in the front-rear direction of the inclined surface 42C. The foremost end edge (including the front end edges of the fitting portions 41) of the upper housing 3 is located at a position on the rear side with respect to the foremost end edge (including the rear end edges of the fitting holes 24B) of the lower housing 2, and the rearmost end edge of the upper housing 3 is located at a position on the rear side with respect to the rearmost end edge of the lower housing 2. The front ends of the elastic locking pieces 42 are located on the rear side with respect to the rear ends of the side wall portions 25.

The assembly detection ribs 33A are located at positions at which they interfere with the swinging locking portions 46 when the swinging locking portions 46 swing. Specifically, the rear end of each of the assembly detection ribs 33A is located on the rear side with respect to the front end of the swinging locking portion 46, and the front end thereof is located on the front side with respect to the front end of the swinging locking portion 46. Accordingly, when the swinging locking portions 46 swing, the base end plate portions 46A of the swinging locking portions 46 interfere with the assembly detection ribs 33A.

The front ends of the first assembling portions 50 are located on the rear side with respect to the first assembling locking portions 25A. The front ends of the second assembling portions 51 are located on the rear side with respect to the second assembling locking portions 28A. The front ends of the third assembling portions 52 are located on the rear side with respect to the third assembling locking portions 31A. The pins 30 are located at the front end portions of the relief holes 43.

Figure 20:
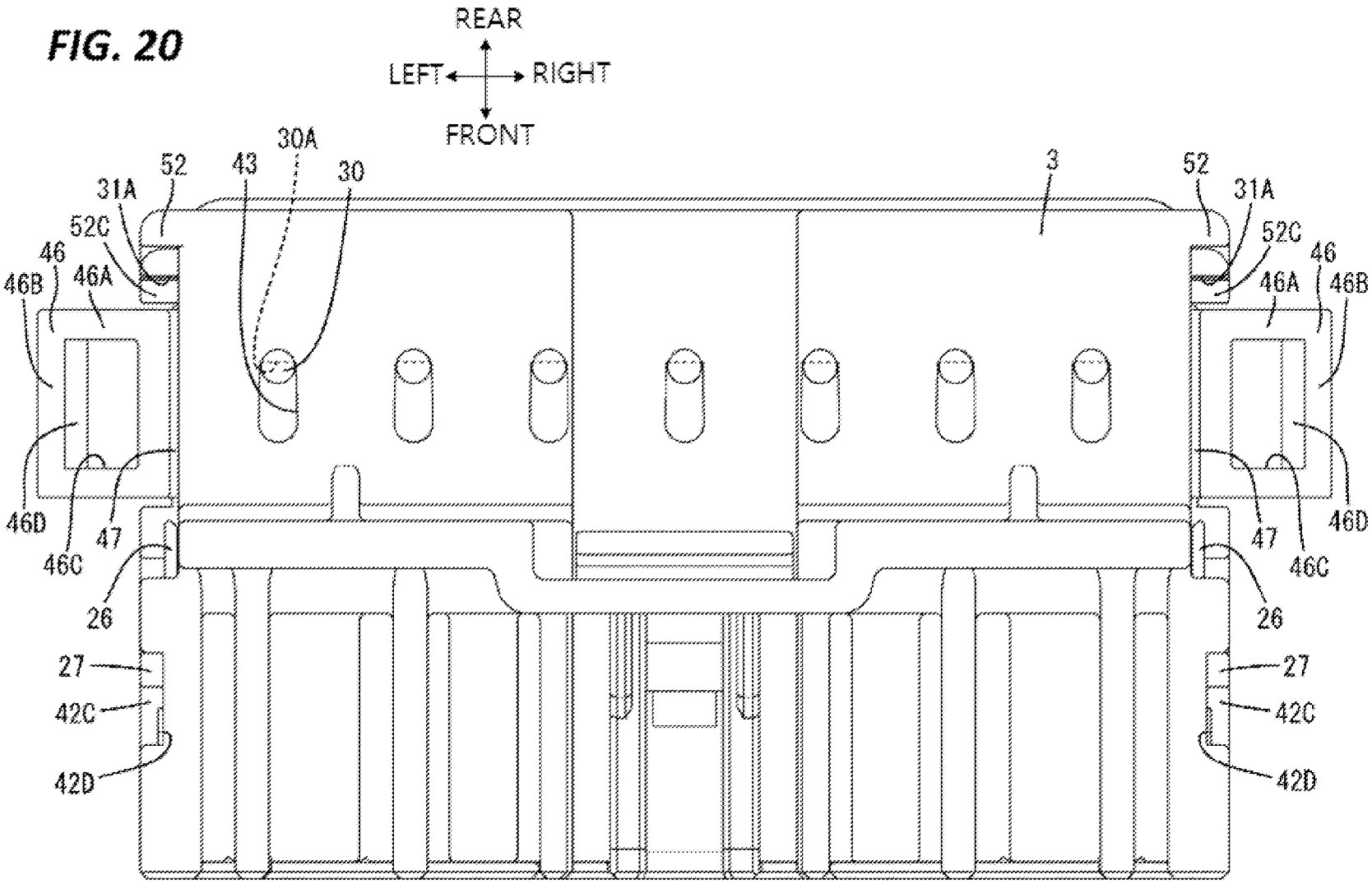
FIG. 20 is a plan view showing a state in which the lower housing and the upper housing are assembled.
Figure 21:
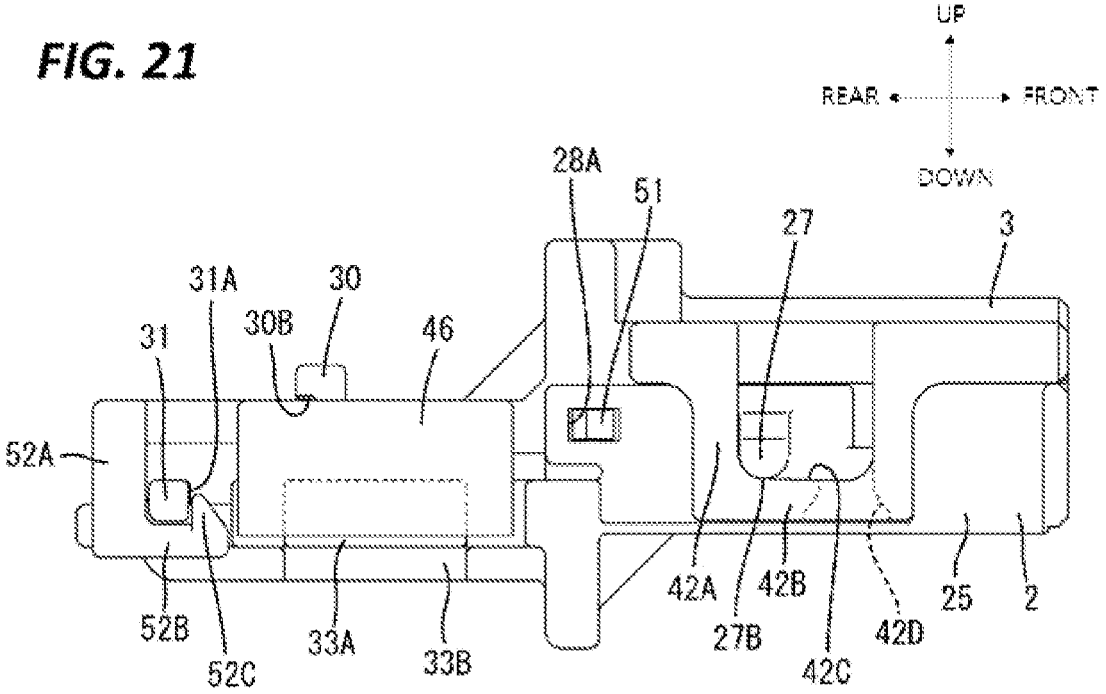
FIG. 21 is a side view showing the state in which the lower housing and the upper housing are assembled.

As shown in FIGS. 20 and 21, the upper housing 3 is moved forward relative to the lower housing 2 and is thus assembled to the lower housing 2. That is, in the connector 1, a direction toward the front side of the lower housing 2 is taken as the predetermined assembly direction. In the process of moving the upper housing 3 forward relative to the lower housing 2 to assemble the upper housing 3 to the lower housing 2, the protruding piece portions 27 are moved rearward relative to the inclined surfaces 42C, above the inclined surfaces 42C. Specifically, each of the protruding piece portion 27 is moved from the position located on the front side with respect to the inclined surface 42C in the front-rear direction to a position located on the rear side with respect to the inclined surface 42C in the front-rear direction. Since the inclined surfaces 42C are inclined downward toward the front side, the movable ranges of the protruding piece portions 27 in the separation direction in which the protruding piece portions 27 and the inclined surfaces 42C are separated from each other are reduced as the protruding piece portions 27 are moved rearward relative to the inclined surfaces 42C. This configuration makes it possible to suppress looseness of the lower housing 2 and the upper housing 3 in the separation direction.

Figure 22:
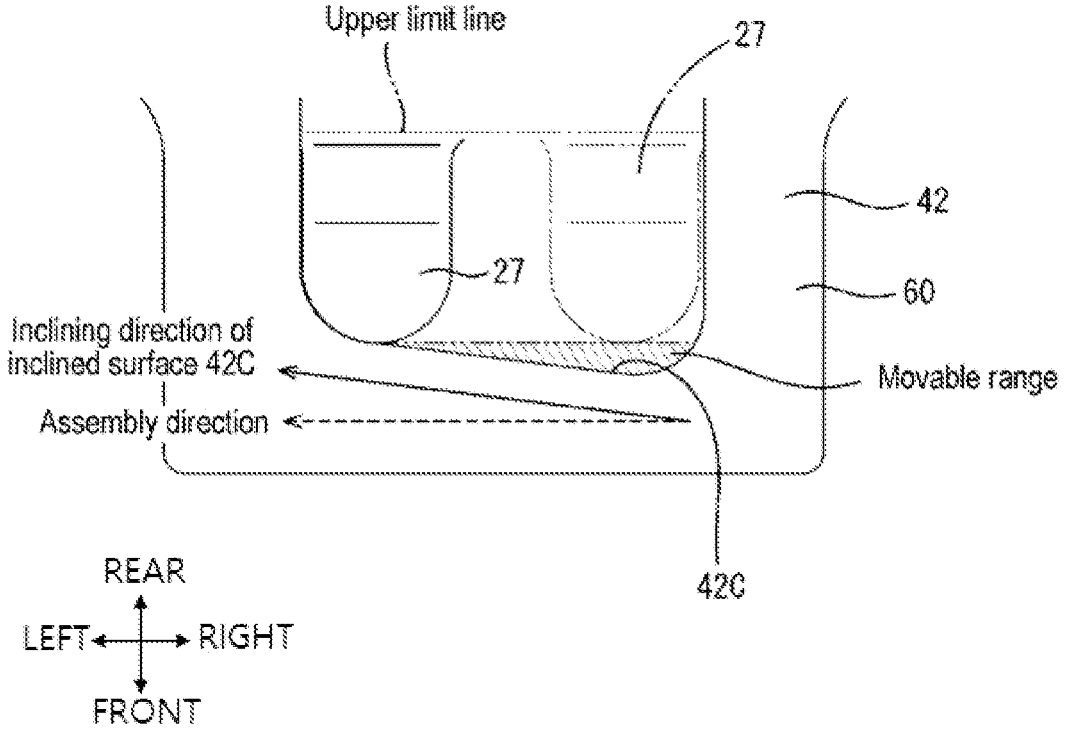
FIG. 22 is an explanatory diagram that conceptually shows a movable range of the protruding piece portion in a separation direction.

Here, the structure in which the movable ranges of the protruding piece portions 27 in the separation direction are reduced as the protruding piece portions 27 are moved rearward relative to the inclined surfaces 42C will be described in detail with reference to FIG. 22. As shown in FIG. 22, each of the inclined surface 42C is inclined upward toward the rear side in the assembly direction. Downward movement (movement in the coupling direction) of the protruding piece portion 27 is restricted by the inclined surface 42C. In the state in which the lower housing 2 and the upper housing 3 are coupled to each other, upward movement (movement in the separation direction) of the protruding piece portion 27 is restricted at the upper limit line extending in the assembly direction. Accordingly, as shown in FIG. 22, in the state in which the protruding piece portion 27 is located on the front side, the movable range of the protruding piece portion 27 in the separation direction in which the protruding piece portion 27 and the inclined surface 42C are separated from each other increases relatively. On the contrary, in the state in which the protruding piece portion 27 is located on the rear side, the movable range of the protruding piece portion 27 in the separation direction in which the protruding piece portion 27 and the inclined surface 42C are separated from each other decreases relatively. That is, the movable ranges of the protruding piece portions 27 in the separation direction are reduced as the protruding piece portions 27 are moved rearward relative to the inclined surfaces 42C.

Also, in the process of moving the upper housing 3 forward relative to the lower housing 2 to assemble the upper housing 3 to the lower housing 2, the fitting portions 41 are fitted into the fitting holes 24B. The pins 30 are moved rearward in the relief holes 43, and the fitting recessed portions 30A of the pins 30 are fitted onto hole edge portions 44 of the relief holes 43. When the lower housing 2 and the upper housing 3 are assembled, the front face of the upper housing 3 comes into contact with the rear face of the front wall portion 24 of the lower housing 2. The front ends of the elastic locking pieces 42 come into contact with the rear ends of the side wall portions 25. The first assembling portions 50 are hooked on the first assembling locking portions 25A and thus restrict movement in a direction opposite to the assembly direction. The second assembling portions 51 are hooked on the second assembling locking portions 28A and thus restrict movement in a direction opposite to the assembly direction. The protrusions 52C of the third assembling portions 52 are hooked on the third assembling locking portions 31A and thus restrict movement in a direction opposite to the assembly direction. The hole edge portions 44 come into contact with the pin restriction portions 30B of the pins 30 and thus restrict upward movement. In this manner, the lower housing 2 and the upper housing 3 are assembled.

Figure 23:
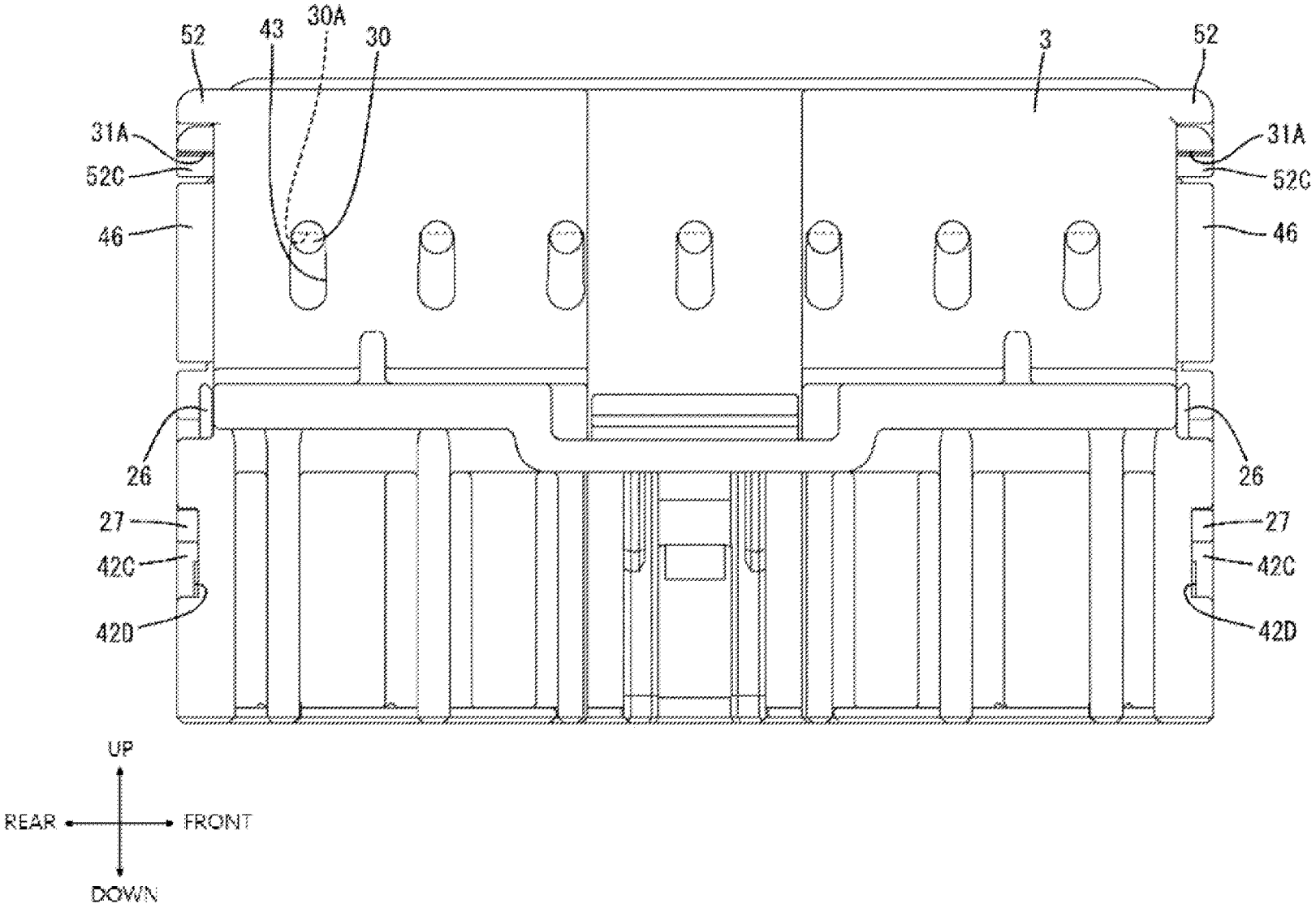
FIG. 23 is a plan view showing a state in which a swinging locking portion is hooked on a hook portion after the lower housing and the upper housing are assembled.
Figure 24:
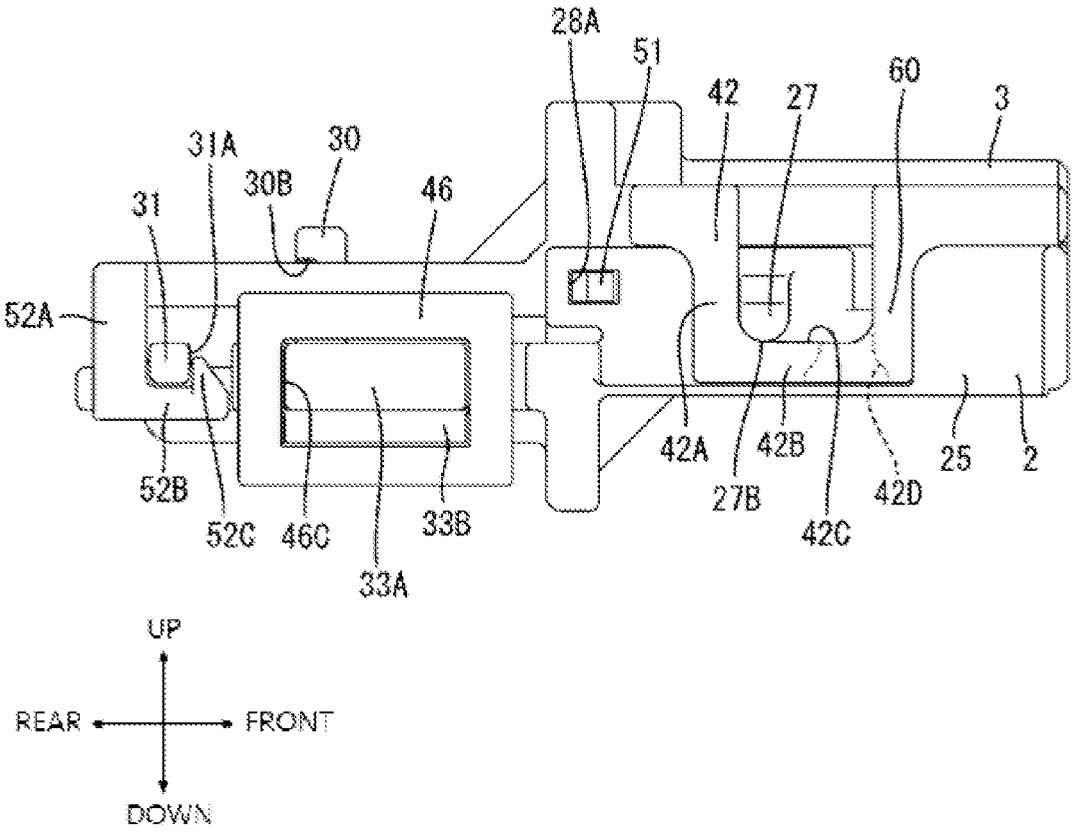
FIG. 24 is a side view showing the state in which the swinging locking portion is hooked on the hook portion after the lower housing and the upper housing are assembled.

In the assembled state, the front ends of the assembly detection ribs 33A are located on the rear side with respect to the front ends of the second openings 46C, and the rear ends of the assembly detection ribs 33A are located on the front side with respect to the rear ends of the second openings 46C. Accordingly, as shown in FIGS. 23 and 24, when the swinging locking portions 46 are swung downward at a substantially right angle, the assembly detection ribs 33A fit into the second openings 46C. That is, the swinging locking portions 46 are allowed to be hooked on the assembly detection ribs 33A (hook portions 33) only in the state in which the lower housing 2 and the upper housing 3 are located at positions at which they are in the assembled state. Moreover, the swinging locking protrusions 46D of the swinging locking portions 46 are elastically hooked on the hook faces 33C, and thus movement of the lower housing 2 and the upper housing 3 in the direction in which the lower housing 2 and the upper housing 3 are separated from each other is restricted. This configuration makes it possible to further suppress looseness of the lower housing 2 and the upper housing 3 in the separation direction.

Figure 25:
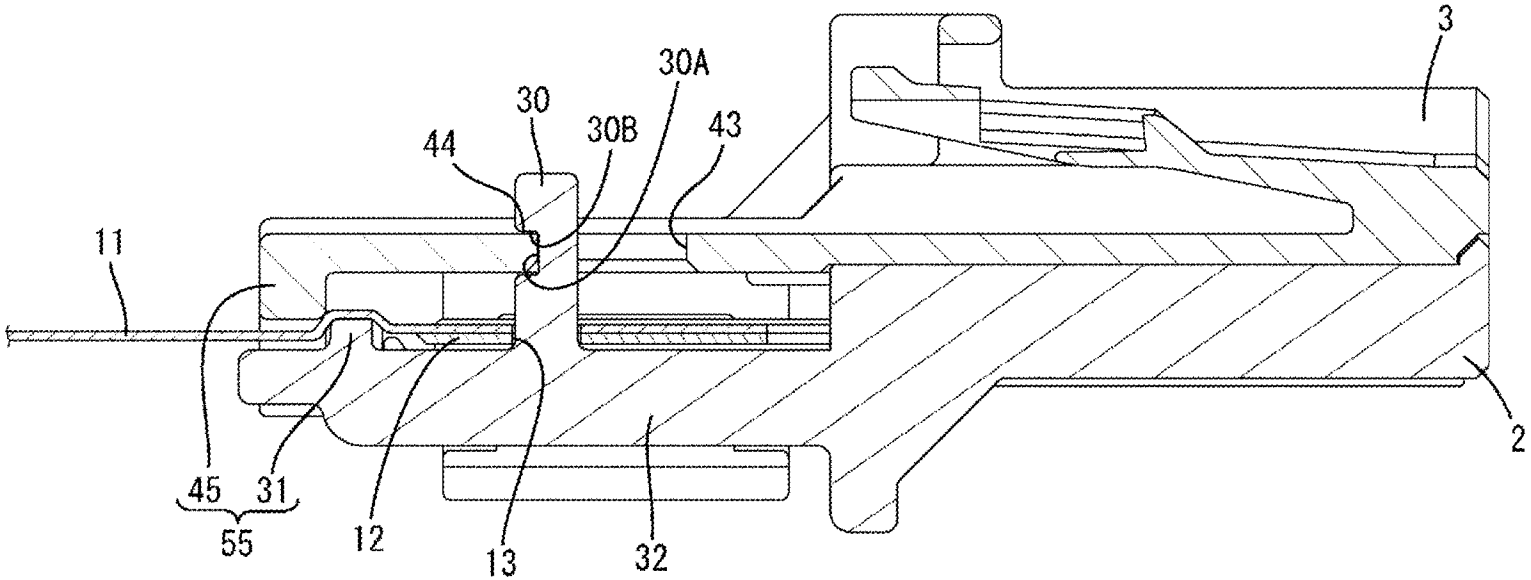
FIG. 25 is a cross-sectional side view of the connector.

In the assembled state, as shown in FIG. 25, the gap between the upper rib 45 and the lower rib 31 is smaller than or equal to the thickness of the sheet-like member 11. More specifically, the gap between the front end corner portion of the bottom face of the upper rib 45 and the rear end corner portion of the top face of the lower rib 31 is smaller than or equal to the thickness of the sheet-like member 11. Accordingly, the sheet-like member 11 is sandwiched between the upper rib 45 and the lower rib 31 in a bent state and held thereby. That is, the upper rib 45 and the lower rib 31 form a strain relief portion 55. This strain relief portion 55 is located on the rear side with respect to the pins 30 and on the rear side with respect to the connection portions where the terminal fittings 10 are connected to the conductors.

<Functions and Effects of Embodiment 1>

As described above, the connector 1 of Embodiment 1 includes the lower housing 2 and the upper housing 3 that are first coupled to each other and brought into the coupled state, and then are moved relative to each other in the assembly direction intersecting the coupling direction and brought into the assembled state. The connector 1 includes the plurality of terminal fittings 10 that are lined up and accommodated between the lower housing 2 and the upper housing 3 in the assembled state. The lower housing 2 is provided with the locking portions 27B. The upper housing 3 is provided with the elastic locking pieces 42 that are hooked on the locking portion 27B. The elastic locking pieces 42 have a cantilever shape, and are elastically deformed and become inclined in the process of coupling the lower housing 2 and the upper housing 3 to each other. After the lower housing 2 and the upper housing 3 have been coupled, the elastic locking pieces 42 are elastically restored while swinging, are hooked on the locking portions 27B, and restrict movement of the lower housing 2 and the upper housing 3 in the separation direction in which the lower housing 2 and the upper housing 3 are separated from each other. The lower housing 2 is provided with the protruding piece portions 27 that protrude outward in the left-right direction. The upper housing 3 is provided with the inclined surfaces 42C that reduce the movable ranges of the protruding piece portions 27 in the separation direction in the process of moving the lower housing 2 forward relative to the upper housing 3.

With this connector 1, in the process of completing the assembly after bringing the connector 1 into the coupled state by hooking the elastic locking pieces 42 on the locking portions 27B, the movable ranges of the protruding piece portions 27 in the separation direction are reduced. Accordingly, looseness of the lower housing 2 and the upper housing 3 in the separation direction can be suppressed.

The inclined surfaces 42C are formed on the elastic locking pieces 42, and the locking portions 27B are formed on the protruding piece portions 27.

With this configuration, the structure of the connector 1 can be simplified compared with the case where the elastic locking pieces 42 and the inclined surfaces 42C are separately formed, or the protruding piece portions 27 and the locking portions 27B are separately formed.

The upper housing 3 is provided with the fitting portions 41. The lower housing 2 is provided with the fitting holes 24B into which the fitting portions 41 are fitted in the process of moving the lower housing 2 and the upper housing 3 in the coupled state relative to each other to bring them into the assembled state.

With this configuration, the two housings 2 and 3 are fitted to each other in the process of assembling the two housings 2 and 3 in the coupled state, and therefore, movement of the two housings 2 and 3 in the assembled state is restricted in the separation direction intersecting the assembly direction. Accordingly, looseness of the two housings 2 and 3 in the separation direction can be more reliably suppressed.

The elastic locking pieces 42 are provided with the lock positioning portions 42D for positioning the lower housing 2 and the upper housing 3 in the assembly direction such that the lower housing 2 and the upper housing 3 can be coupled.

Accordingly, the two housings 2 and 3 can be easily positioned in the assembly direction when being coupled.

The lower housing 2 is provided with the pins 30 that rise toward the upper housing 3 side. The upper housing 3 is provided with the relief holes 43 through which the pins 30 pass. Each of the pins 30 is provided with the pin restriction portion 30B that restricts movement of the hole edge portion 44 included in the inner circumference of the relief hole 43 in the separation direction.

Accordingly, movement of the hole edge portions 44 in the separation direction is restricted in the assembled state, and thus looseness of the two housings 2 and 3 in the separation direction can be more reliably suppressed.

The upper housing 3 is provided with the swinging locking portions 46 that swing about the hinges 47 serving as supporting points, at two ends thereof in a direction orthogonal to the coupling direction. The lower housing 2 is provided with the hook portions 33 on which the swinging locking portions 46 are allowed to be hooked only in the state in which the lower housing 2 and the upper housing 3 are located at positions at which they are in the assembled state.

Accordingly, due to the swinging locking portions 46 being hooked on the hook portions 33, looseness of the two housings 2 and 3 in the separation direction can be suppressed, and it can be confirmed whether or not two housings 2 and 3 are in the assembled state.

The connector 1 of Embodiment 1 includes the lower housing 2 and the upper housing 3 that are assembled in the vertical direction such that the lower housing 2 is located on the lower side and the upper housing 3 is located on the upper side. The connector 1 includes the plurality of terminal fittings 10 that are lined up and accommodated between the lower housing 2 and the upper housing 3 that have been assembled, in a dislodgement preventing state. The connector 1 includes the flat cable 4 including the plurality of conductors that are respectively connected to the plurality of terminal fittings 10, and the sheet-like member 11 that covers the plurality of conductors. The connector 1 includes the pins 30 that rise from the top face of the lower housing 2. In the connector 1, the reinforcing holes 13 that pass through the sheet-like member 11 and can lock the pins 30 inserted therethrough are formed.

In this connector 1, the pins 30 pass through the sheet-like member 11, and the sheet-like member 11 are caught on the pins 30 when the sheet-like member 11 is pulled rearward. Therefore, pulling force that is applied to the connection portion where the conductors are connected to the terminal fittings 10 is reduced. Accordingly, it is possible to suppress damage to the connection portion where the conductors are connected to the terminal fittings 10.

The connector 1 of Embodiment 1 includes the lower housing 2 and the upper housing 3 that are assembled in the vertical direction such that the lower housing 2 is located on the lower side and the upper housing 3 is located on the upper side. The connector 1 includes the plurality of terminal fittings 10 that are lined up and accommodated between the lower housing 2 and the upper housing 3 that have been assembled, in a dislodgement preventing state. The connector 1 includes the flat cable 4 including the plurality of conductors that are respectively connected to the plurality of terminal fittings 10, the sheet-like member 11 that covers the plurality of conductors, and the reinforcing plate 12 that is stronger than the sheet-like member 11 and is integrated with an end portion of the sheet-like member 11 that is located near the terminal fittings 10. The connector 1 includes the pins 30 that rise from the top face of the lower housing 2. In the connector 1, the reinforcing holes 13 that pass through the reinforcing plate 12 and can lock the pins 30 inserted therethrough are formed.

In this connector 1, the pins 30 pass through the reinforcing plate 12, and the reinforcing plate 12 are caught on the pins 30 when the sheet-like member 11 is pulled rearward. Therefore, pulling force applied to the sheet-like member 11 is prevented from being applied to the connection portion where the conductors are connected to the terminal fittings 10. Accordingly, it is possible to prevent the connection portion from being damaged where the conductors are connected to the terminal fittings 10.

The lower housing 2 and the upper housing 3 include the strain relief portion 55 that holds the sheet-like member 11 in the state in which the sheet-like member is bent and inserted thereinto.

With this configuration, the strain relief portion 55 can prevent pulling force from being applied to the connection portion where the conductors are connected to the terminal fittings 10 when the sheet-like member 11 is pulled rearward. Accordingly, it is possible to more reliably prevent the connection portion from being damaged where the conductors are connected to the terminal fittings 10.

The upper housing 3 is provided with the relief holes 43 through which the pins 30 pass. Each of the pins 30 is provided with the pin restriction portion 30B that restricts upward movement of the hole edge portion 44 included in the inner circumference of the relief hole 43.

With this configuration, upward movement of the hole edge portions 44 is restricted by the pin restriction portions 30B, and thus upward movement of the upper housing 3 is restricted. Accordingly, the lower housing 2 and the upper housing 3 are prevented from being separated from each other, thus making it possible to improve the force applied by the strain relief portion 55 to restrain the sheet-like member 11.

The upper housing 3 is moved in the direction in which the hook allowances between the hole edge portions 44 and the pin restriction portions 30B increase, and is thus assembled to the lower housing 2.

With this configuration, in the state in which the upper housing 3 is assembled to the lower housing 2, the hook allowances between the hole edge portions 44 and the pin restriction portions 30B increase, and therefore, upward movement of the upper housing 3 is more reliably restricted.

Accordingly, it is possible to further improve the force applied by the strain relief portion 55 to restrain the sheet-like member 11.

The upper housing 3 is provided with the swinging locking portions 46 that swing about the hinges 47 serving as supporting points, at two ends thereof in the front-rear direction or the left-right direction. The lower housing 2 is provided with the hook portions 33 that restrict movement of the lower housing 2 and the upper housing 3 in the direction in which the lower housing 2 and the upper housing 3 are separated from each other due to the swinging locking portions 46 are hooked thereon.

With this configuration, due to the swinging locking portion 46 being hooked on the hook portions 33, movement of the lower housing 2 and the upper housing 3 in the direction in which the lower housing 2 and the upper housing 3 are separated from each other can be restricted. Accordingly, it is possible to further improve the force applied by the strain relief portion 55 to restrain the sheet-like member 11.

The lower housing 2 is provided with the reinforcing ribs 32 extending in the front-rear direction.

With this configuration, the lower housing 2 is less likely to warp, and thus the housings 2 and 3 are prevented from being separated from each other. Accordingly, it is possible to further improve the force applied by the strain relief portion 55 to restrain the sheet-like member 11.

Other Embodiments

The present invention is not limited to the embodiment described in the description above and the drawings, and for example, the following embodiments are also included in the technical scope of the present invention.

(1) In Embodiment 1 above, the locking portions are formed on the protruding piece portions, and the inclined surfaces are formed on the elastic locking pieces. However, the locking portions may be formed on portions other than the protruding piece portions in the lower housing, or a configuration may be employed in which protruding piece restriction portions that are separate from the elastic locking pieces are provided in the upper housing, and the inclined surfaces are formed on the protruding piece restriction portions.

(2) In Embodiment 1 above, the lower housing is provided with the protruding piece portions, and the upper housing is provided with the elastic locking pieces. However, a configuration may also be employed in which the lower housing is provided with the elastic locking pieces, and the upper housing is provided with the protruding piece portions.

(3) In Embodiment 1 above, the reinforcing holes are formed in both the sheet-like member and the reinforcing plate. However, the reinforcing holes need only be formed in at least the reinforcing plate, and need not be formed in the sheet-like member.

(4) In Embodiment 1 above, the reinforcing plate is attached to the underside of the sheet-like member and is thus integrated therewith, but the reinforcing plate may be integrated therewith by employing another configuration. For example, the reinforcing plate may be integrated with the sheet-like member by coupling the reinforcing plate to the sheet-like member in the in-plane direction.

(5) In Embodiment 1 above, the reinforcing ribs are formed on the first housing, but may be formed on the second housing or on both of the housings. The positions at which the reinforcing ribs are formed may be located on the bottom face, or top face, or both the top and bottom faces, of the housing. In addition, in Embodiment 1 above, the reinforcing ribs are arranged to pass just below the pins, but the reinforcing ribs need not pass just below the pins.

(6) In Embodiment 1 above, the flat cable includes the reinforcing plate, but a configuration may also be employed in which the flat cable does not include the reinforcing plate. In this case, the reinforcing holes are formed in the sheet-like member.

LIST OF REFERENCE NUMERALS

1 . . . Connector
2 . . . Lower housing (corresponding to first housing of the present invention)
3 . . . Upper housing (corresponding to second housing of the present invention)
4 . . . Flat cable
10 . . . Terminal fitting
11 . . . Sheet-like member
12 . . . Reinforcing plate
13 . . . Reinforcing hole
24B . . . Fitting hole
27 . . . Protruding piece portion
27B . . . Locking portion
30 . . . Pin
30A . . . Fitting recessed portion
30B . . . Pin restriction portion
33 . . . Hook portion
33A . . . Assembly detection rib
33C . . . Hook face
41 . . . Fitting portion
42 . . . Elastic locking piece
42C . . . Inclined surface
42D . . . Lock positioning portion
43 . . . Relief hole
44 . . . Hole edge portion
46 . . . Swinging locking portion
47 . . . Hinge
55 . . . Strain relief portion
60 . . . Piece restriction portion

What is claimed is:

1. A connector comprising:

a first housing and a second housing that are first coupled to each other and brought into a coupled state, and then are moved relative to each other in a front-rear direction and brought into an assembled state;

a terminal fitting that is accommodated between the first housing and the second housing;

a locking portion that is formed on the first housing;

an elastic locking piece that has a cantilever shape, is formed on the second housing, is hooked on the locking portion in the coupled state, and restricts upward movement of the second housing relative to the first housing;

a protruding piece portion that is formed on one of the first housing and the second housing, and protrudes outward in a left-right direction; and a protruding piece restriction portion that is formed on the other of the first housing and the second housing, and restricts upward movement of the protruding piece portion, wherein the protruding piece restriction portion is provided with an inclined surface that is inclined in a forward direction to gradually reduce a movable range of the protruding piece portion in an upward direction when the protruding piece portion is moved rearward relative to the inclined surface, above the inclined surface in a process of assembling the first housing and the second housing.

2. The connector according to claim 1, wherein the protruding piece restriction portion is constituted by the elastic locking piece, the inclined surface is formed on the elastic locking piece, and the protruding piece portion is constituted by the locking portion.

3. The connector according to claim 1, wherein one of the first housing and the second housing is provided with a fitting portion, and the other of the first housing and the second housing is provided with a fitting hole into which the fitting portion is fitted in a process of moving the first housing and the second housing in the coupled state relative to each other to bring the first housing and the second housing into the assembled state.

4. The connector according to claim 1, wherein the elastic locking piece is provided with a lock positioning portion that positions the protruding piece portion before the first housing and the second housing are brought into the coupled state.

5. The connector according to claim 1, wherein one of the first housing and the second housing is provided with a pin that rises toward the other housing, the other housing is provided with a relief hole through which the pin passes, and the pin is provided with a pin restriction portion that restricts movement of a hole edge portion included in an inner circumference of the relief hole in the separation direction in the assembled state.

6. The connector according to claim 1, wherein one of the first housing and the second housing is provided with swinging locking portions that swing about hinges serving as a supporting point, at two ends thereof in the left-right direction, and the other housing is provided with hook portions on which the swinging locking portions are hooked only in a state in which the first housing and the second housing are located at positions at which they are in the assembled state.

7. The connector according to claim 1, wherein the protruding piece portion is provided with a guide face that is inclined downward and outward.

8. The connector according to claim 1, wherein an inner face of the protruding piece restriction portion is provided with a lock positioning portion for positioning the first housing and the second housing in the front-rear direction such that the first housing and the second housing are coupled.

* * * * *